United States Patent [19]

Simpson

[11] 4,112,632

[45] Sep. 12, 1978

[54] PREFABRICATED WATERTIGHT STRUCTURAL SYSTEM

[75] Inventor: Harold G. Simpson, Oklahoma City, Okla.

[73] Assignee: Star Manufacturing Company of Oklahoma, Oklahoma City, Okla.

[21] Appl. No.: 625,883

[22] Filed: Oct. 28, 1975

Related U.S. Application Data

[63] Continuation-in-part of Ser. No. 336,364, Feb. 27, 1973, and Ser. No. 624,587, Oct. 22, 1975.

[51] Int. Cl.[2] ..... E04B 7/00; E04D 13/06

[52] U.S. Cl. ..... 52/11; 52/16; 52/60; 52/62; 52/96; 52/219; 52/302

[58] Field of Search ..... 52/58–61, 52/62, 11, 16, 96, 219, 302

[56] References Cited

U.S. PATENT DOCUMENTS

| | | | |
|---|---|---|---|
| 3,381,436 | 5/1968 | Elliott | 52/309 |
| 3,483,664 | 12/1969 | Funk | 52/309 |
| 3,545,147 | 12/1970 | Eastham | 52/96 |

FOREIGN PATENT DOCUMENTS

| | | | |
|---|---|---|---|
| 1,172,363 | 11/1969 | United Kingdom | 52/219 |

*Primary Examiner*—John E. Murtagh

*Attorney, Agent, or Firm*—Hubbard, Thurman, Turner, Tucker & Glaser

[57] ABSTRACT

A prefabricated structural system including a support frame and prefabricated panels having strength sufficient to bridge spaced support beams under the panel is disclosed. Each panel includes a sheet metal support subpanel having corrugations, a thin flat metal sheet as a top surface, and a layer of insulating foam filling the space therebetween. A Hypalon membrane is intimately and continuously bonded to the thin, flat metal sheet and has Hypalon fasteners disposed along each edge of the Hypalon sheet and connected to the Hypalon sheet by flexible flaps. The panels are disposed in a continuous array and fastener halves are joined and the corners sealed to provide a continuous Hypalon membrane unpenetrated by fastener screws above the array of panels. A flashing system is disclosed which continues the Hypalon membrane from the panel array up adjacent parapet walls and building walls and accessories extending above the roof deck and over the edge of the roof deck to the outside of underlying walls to provide a watertight roof structure. The flashing system includes plain and box fascia systems including a box gutter system, parapet flashing, all corner and end transitions for these systems, penetration flashings for vents, pipes, deck drains and curbs.

12 Claims, 53 Drawing Figures

PREFABRICATED WATERTIGHT STRUCTURAL SYSTEM

This is a continuation-in-part of my co-pending application Ser. No. 336,364, filed Feb. 27, 1973, entitled "Construction System," and of my co-pending application Ser. No. 624,587, filed Oct. 22, 1975, entitled "Prefabricated Watertight Structural System," both of which are assigned to the assignee of the present invention.

This invention relates generally to prefabricated structural systems, and more specifically relates to a structural system particularly suited for roofs of buildings or similar structures.

Conventional built-up roofing systems have been a standard of the industry for many years. In this method of construction, a horizontal roof deck, typically corrugated deck and insulation, planking or plywood, is installed on an underlying structural beam system, either wood or steel. The entire roof deck is covered by a continuous weatherproof membrane usually comprising alternate layers of felt and bitumen to prevent penetration of moisture into the building interior. The membrane is applied in a field operation by application of alternate layers of hot or cold bitumen and felt. Once the membrane is applied to the desired thickness, gravel, rock or similar aggregate material is spread upon the roof to provide ballast to hold the roof down against wind generated uplift and to provide protection against weathering and foot traffic. To reduce heat transfer through the roof deck, insulation is often applied to the underside of the roof deck at the interior of the building. Insulation is also sometimes applied on the exterior of the roof deck and subsequently covered with the water resistant membrane and ballast rock.

There are many difficulties with built-up roof systems of the type described above. Since the construction of the built-up roof is entirely a field operation, there is little uniformity of quality from one building to another and consequently the integrity of such a roof structure varies considerably. A built-up roof membrane has a tendency to bubble and crack. This deterioration results from a number of factors including expansion and contraction from severe temperature changes, moisture trapped below the water resistant membrane, and improper construction techniques. Further, built-up roofs do not readily withstand heavy foot traffic and are susceptible to damage from traffic. Also considerable safety and environmental hazards exist in the application of hot tar which often gives off toxic fumes and polluting matter. Because of the undesirable nature of the hot tar process, local and federal safety and pollution standards often prohibit or restrict the use of built-up systems which formerly had wide acceptance.

In co-pending U.S. applications Ser. No. 336,370, filed Feb. 27, 1973, now U.S. Pat. No. 3,909,998, and my co-pending application Ser. No. 336,364, filed Feb. 27, 1973, and my co-pending application Ser. No. 624,587, filed Oct. 22, 1975, entitled "Prefabricated Watertight Structural System," each of which is assigned to the assignee of the present invention, disclosures of each of which are hereby incorporated in this application by reference, a prefabricated panelized roofing system is described and claimed which employs Hypalon membrane panels having superior weathering characteristics as a top surface on prefabricated panels capable of spanning spaced substructural members. These panels include extruded Hypalon fasteners along the edges of the Hypalon membranes which can be engaged after the panels are arrayed in a roof structure and fastened to the underlying structure to form a continuous watertight membrane when the intersections of the fasteners are properly sealed.

The panel system of the last mentioned application has high strength but light weight so that it can be manually lifted, has superior weathering qualities, is reliably fluid-tight, is easily and quickly erected in a wide variety of weather conditions with minimum labor and skill, provides a strong and convenient platform for workmen during all stages of erection, has good resistance to fire resulting from flying embers on the top surface, has superior insulating properties, can withstand extreme temperature cycling, has a relatively high rating for containing interior fire, and can be relatively economically manufactured with a minimum capital investment and minimum transportation cost. The panel also serves as a stable, flat base for accessories and penetrations, and is highly resistant to handling and erection damage. However, the panel system has limited utility unless it can be quickly and easily made compatible with a large number of different conventional wall structures of different architecturally shaped buildings so as to maintain a suitable appearance while maintaining watertight integrity, and is compatible with accessories such as vent pipes, deck drains, air conditioning installations, skylights, and the like.

The present invention is concerned with a roofing system and a method of installaton which provides a watertight membrane over the entire roof, and beyond the edge of the roof to the exterior surface of adjacent walls, while accommodating and/or controlling water run-off from the roof and providing for penetration of the membrane with vent pipes, drains, air conditioning ducts and the like. The invention contemplates a peripheral flashing system which seals the roof membrane to any type wall structure below the roof deck or to a parapet wall rising up adjacent the roof deck. The flashing system includes a fascia and/or gutter system for the edge of the roof decks overhanging walls and parapet flashing and scupper systems for parapet walls, annd penetration flashing for vent pipes and deck drains, and curb flashing for air conditioning ducting, skylights and the like. The system is watertight for either sloping or substantially flat roof decks, and is architecturally attractive, factory prefabricated and quickly and easily installed in substantially any weather conditions.

The novel features believed characteristic of this invention are set forth in the appended claims. The invention itself, however, as well as other objects and advantages thereof, may best be understood by reference to the following detailed description of illustrative embodiments, when read in conjunction with the accompanying drawings, wherein:

Figure 2A:
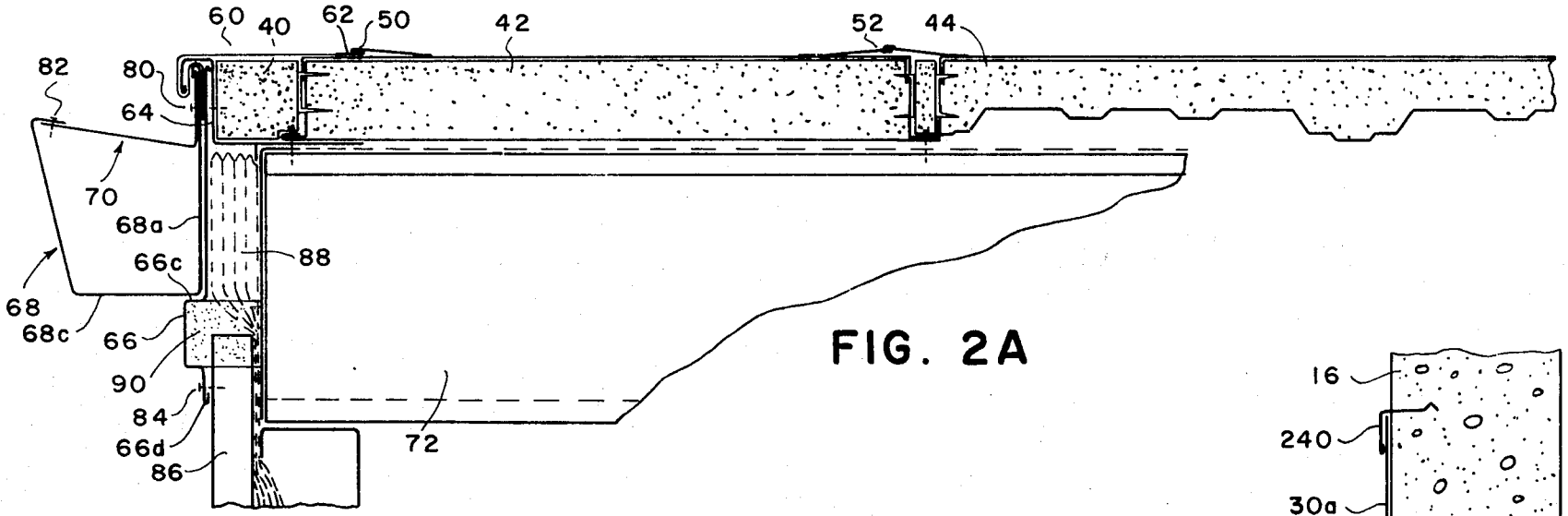
FIG. 2A is a schematic sectional view taken substantially on lines 2A — 2A of FIG. 1.
Figure 2B:
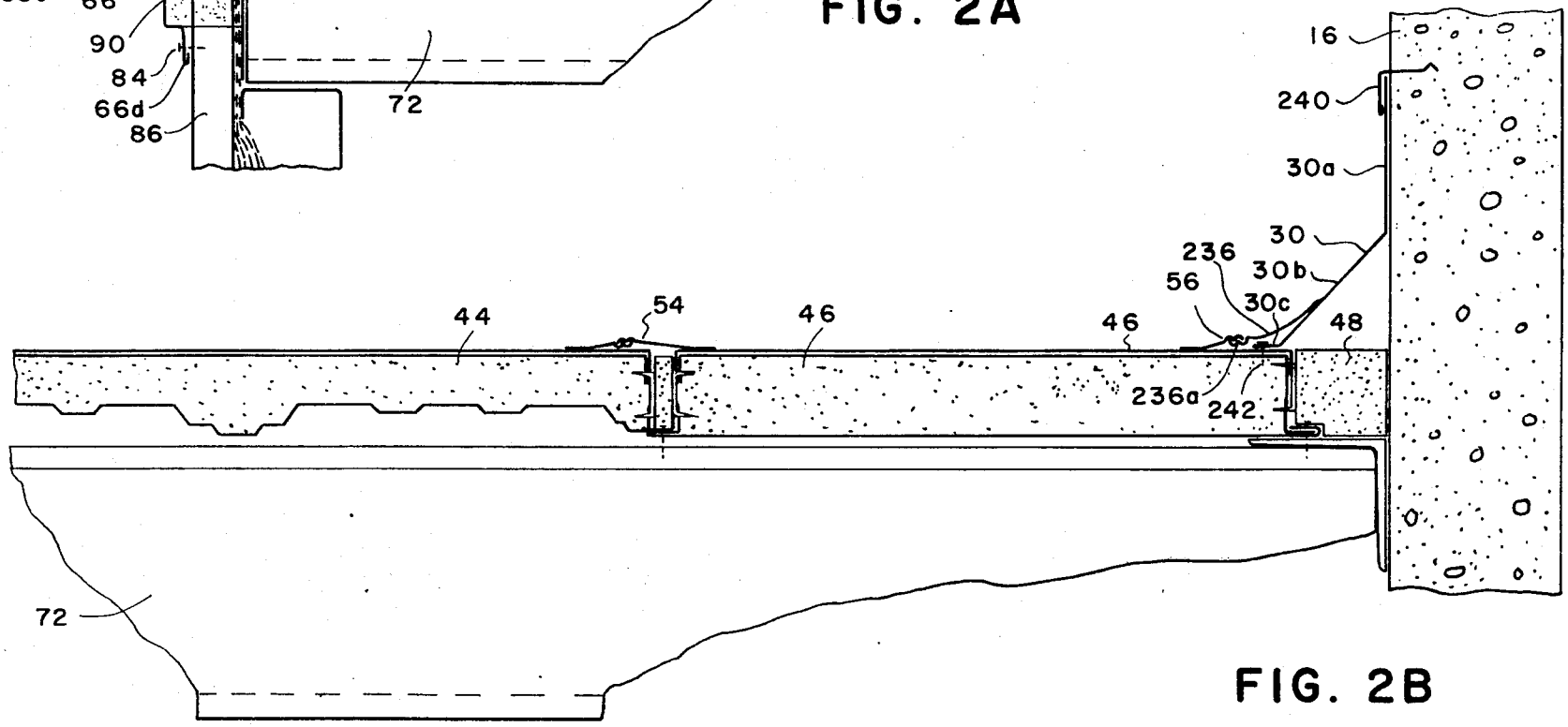
FIG. 2B is a schematic sectional view taken substantially on lines 2B — 2B of FIG. 1.
Figure 19:
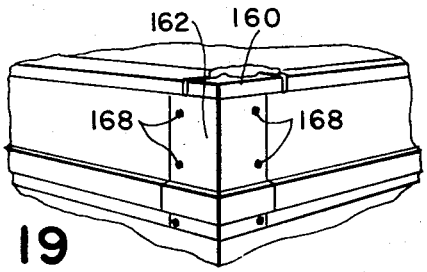
FIGS. 19, 20, 21 and 23 are schematic perspective views of alternative fascia corners in accordance with the present invention.
Figure 20:
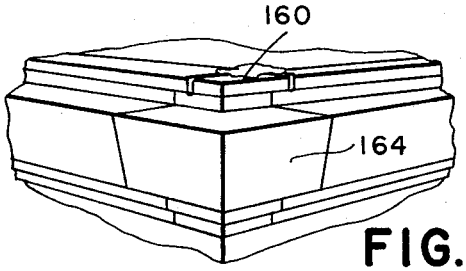
Figure 21:
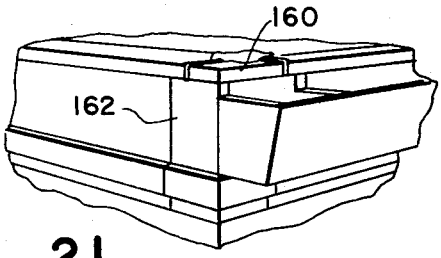
Figure 22:
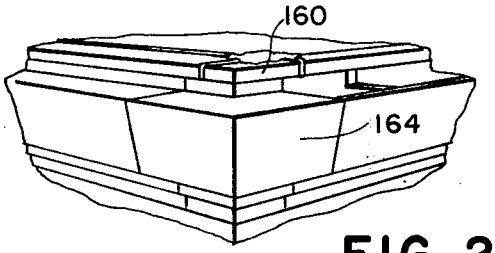
Figure 24:
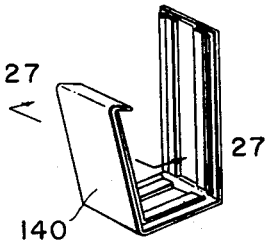
Figure 25:
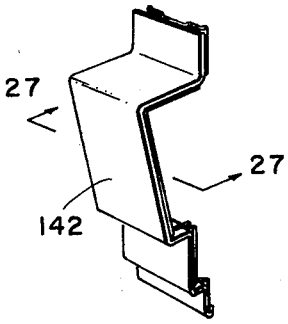
Figure 26:
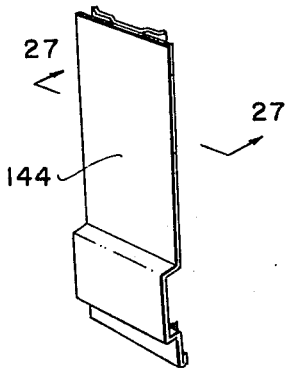
Figure 27:
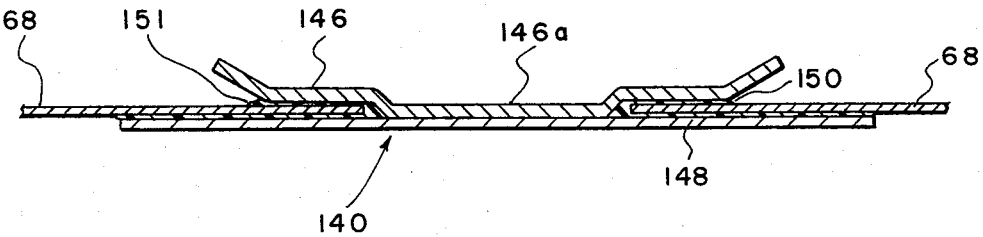
Figure 22A:
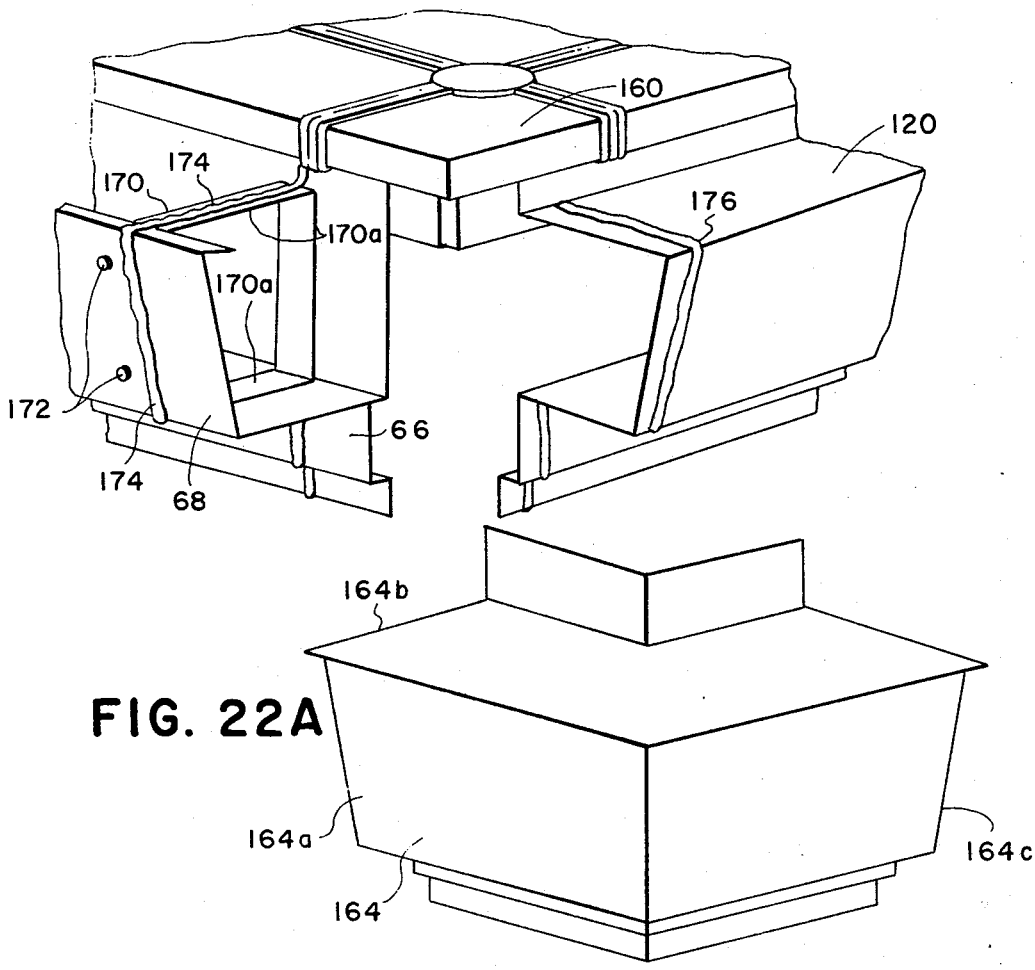
Figure 22B:
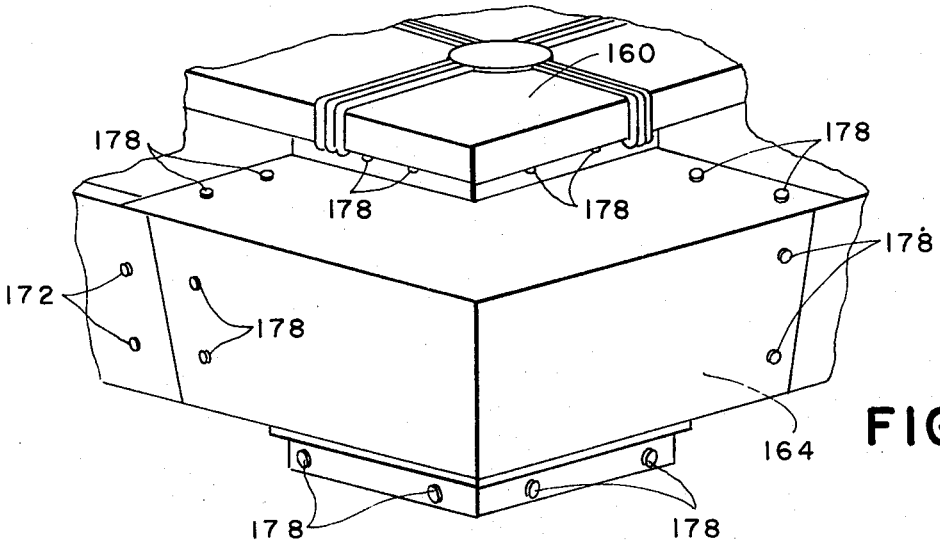
Figure 28:
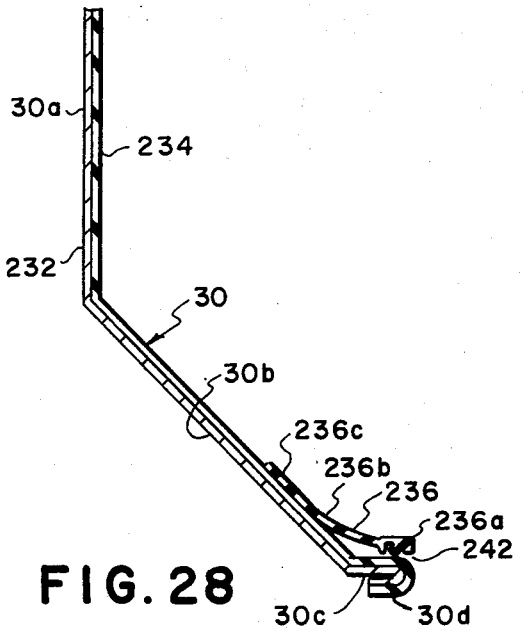
Figure 29:
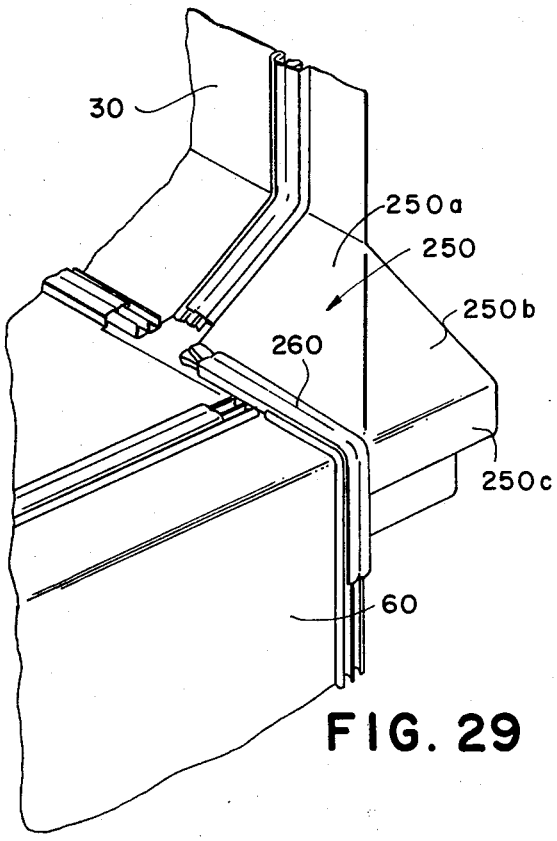
Figure 32:
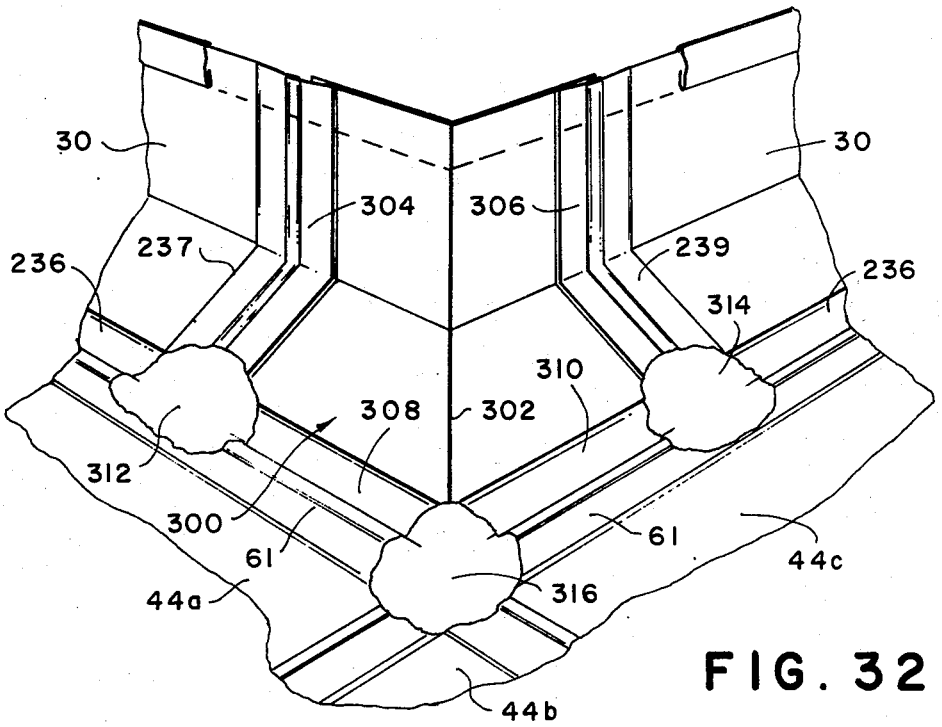
Figure 29A:
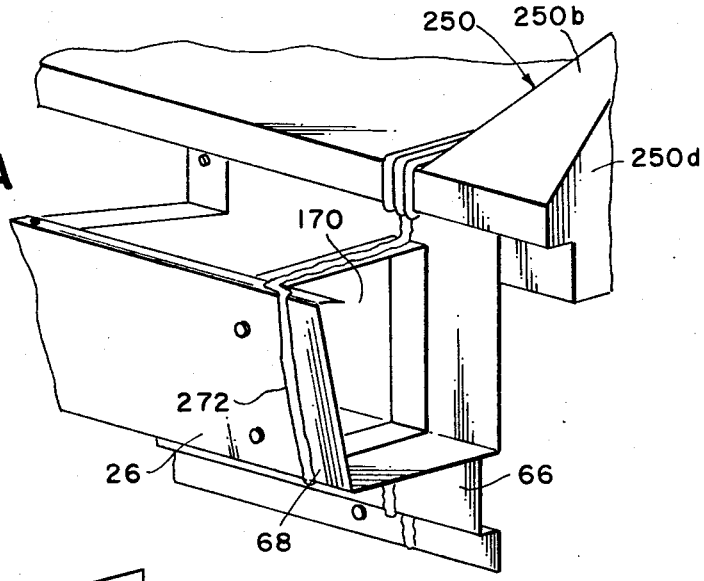
Figure 29B:
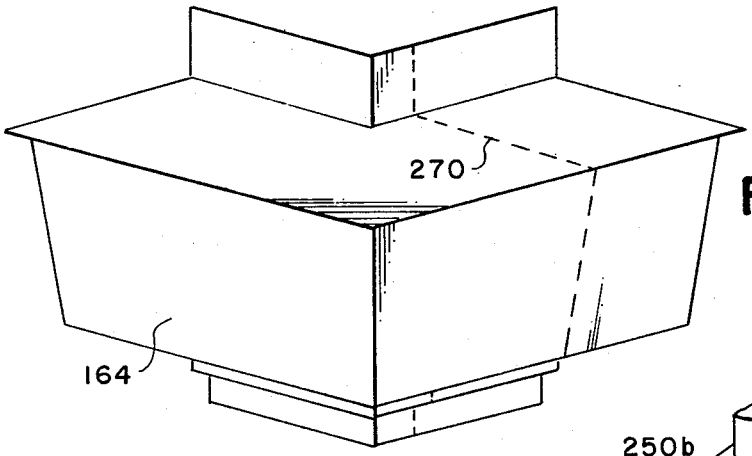
Figure 29C:
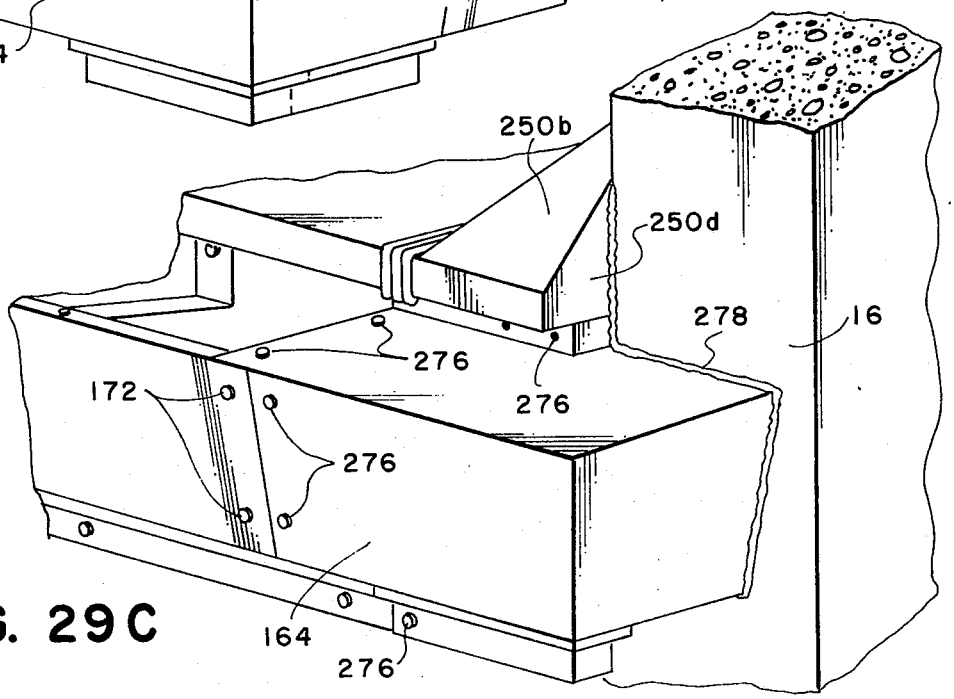
Figure 30:
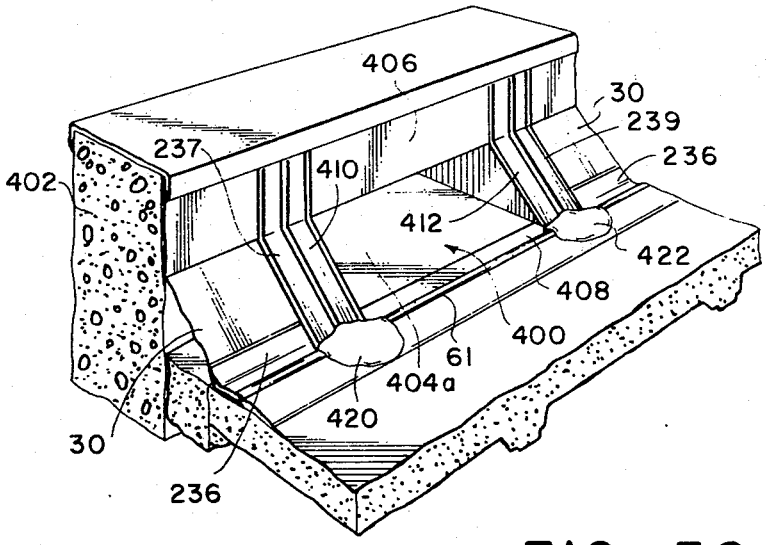
Figure 31:
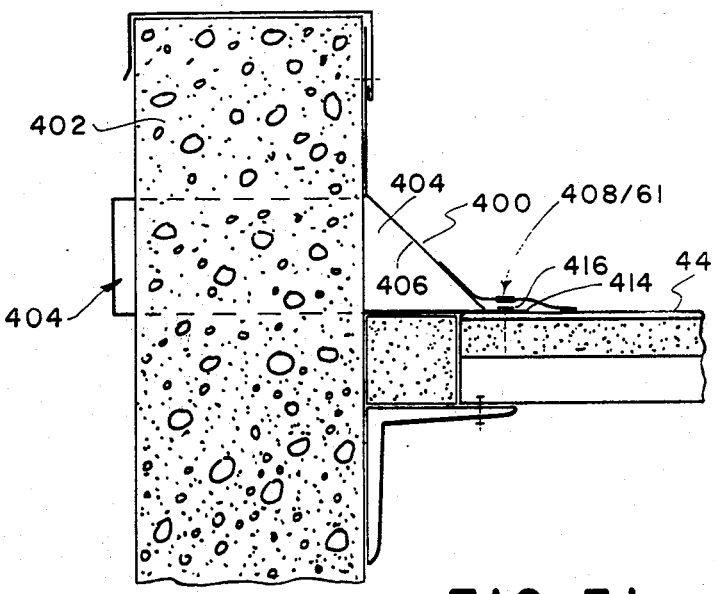
Figure 33:
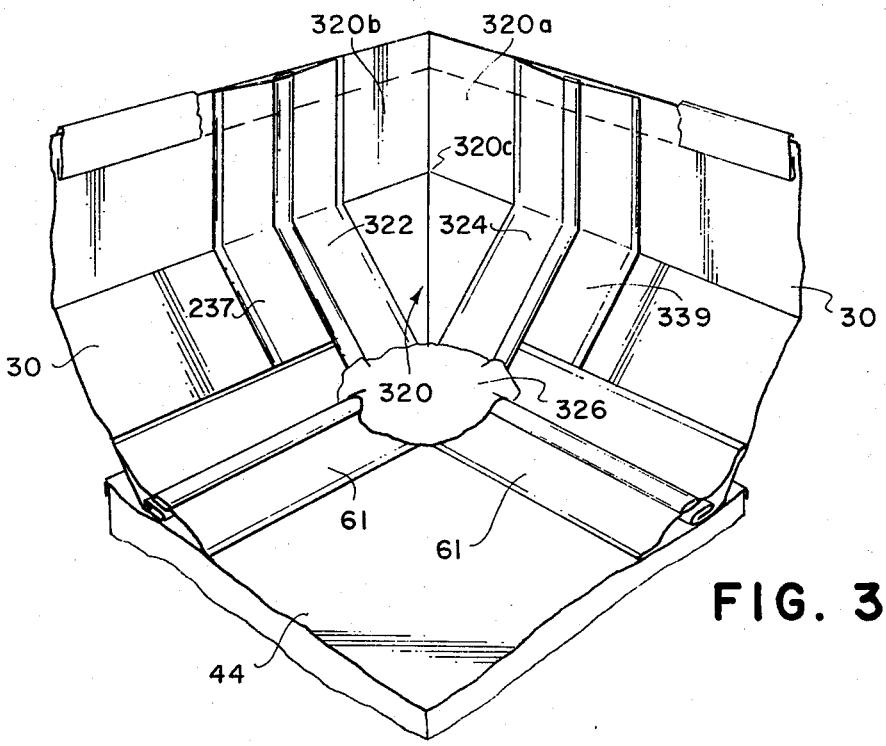
Figure 34:
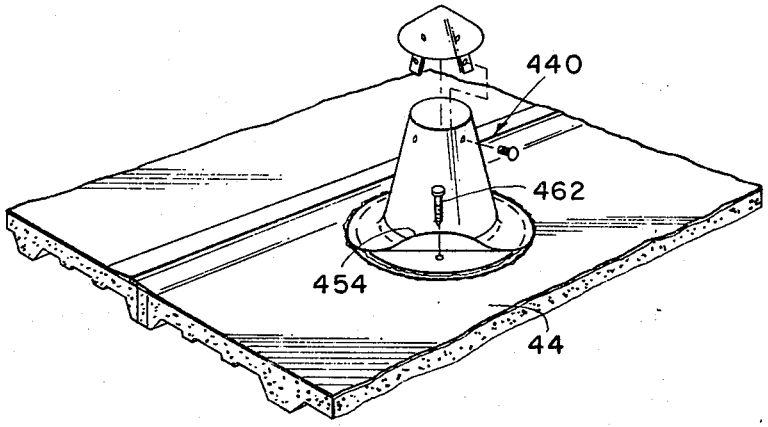
Figure 36:
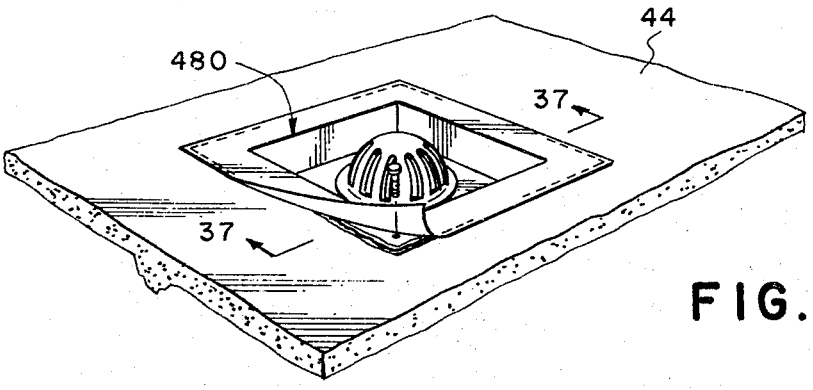
Figure 35:
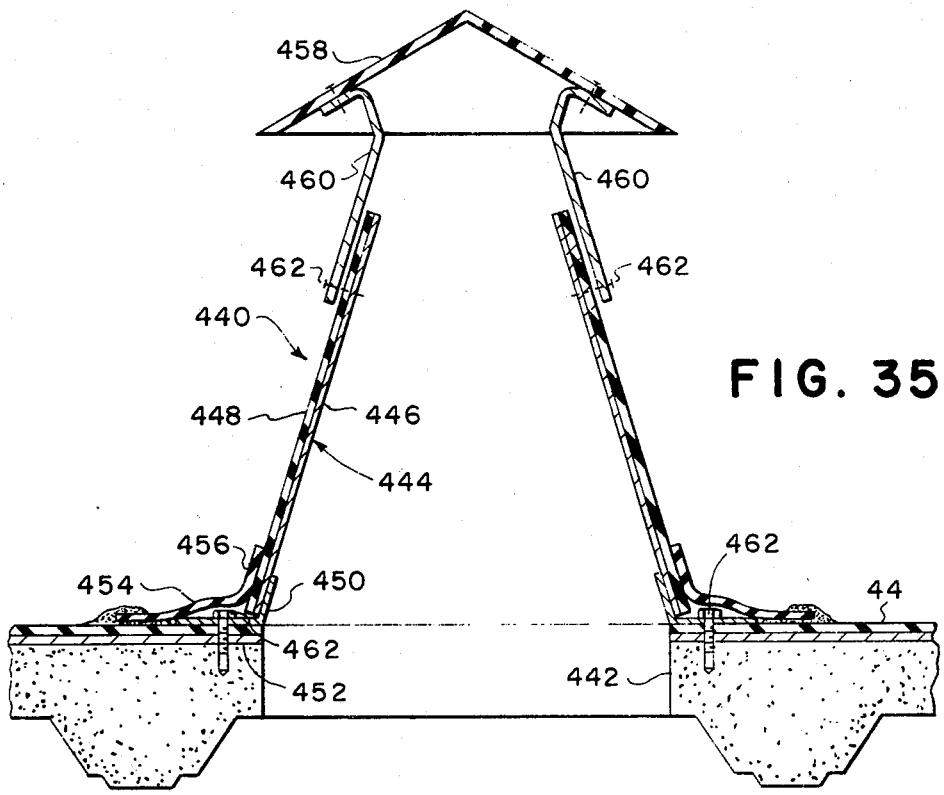
Figure 35A:
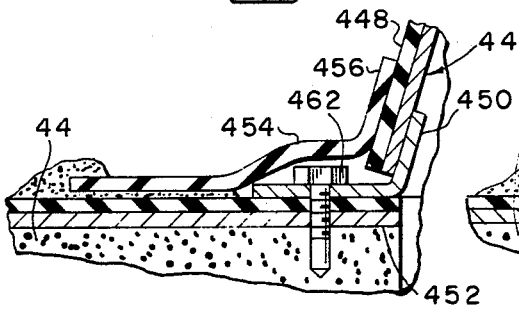
Figure 37A:
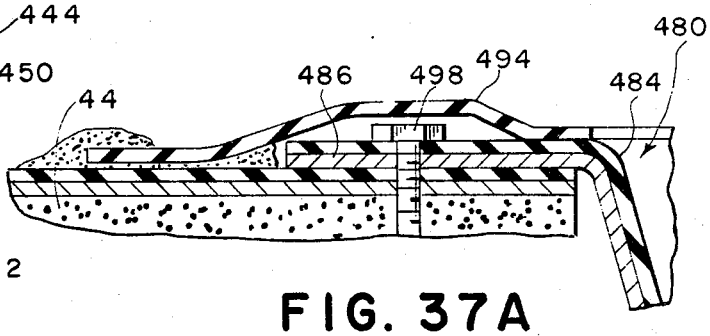
Figure 37:
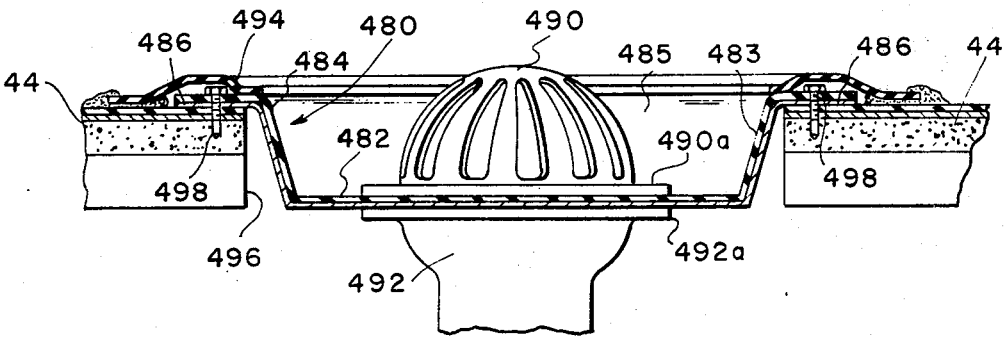
Figure 39:
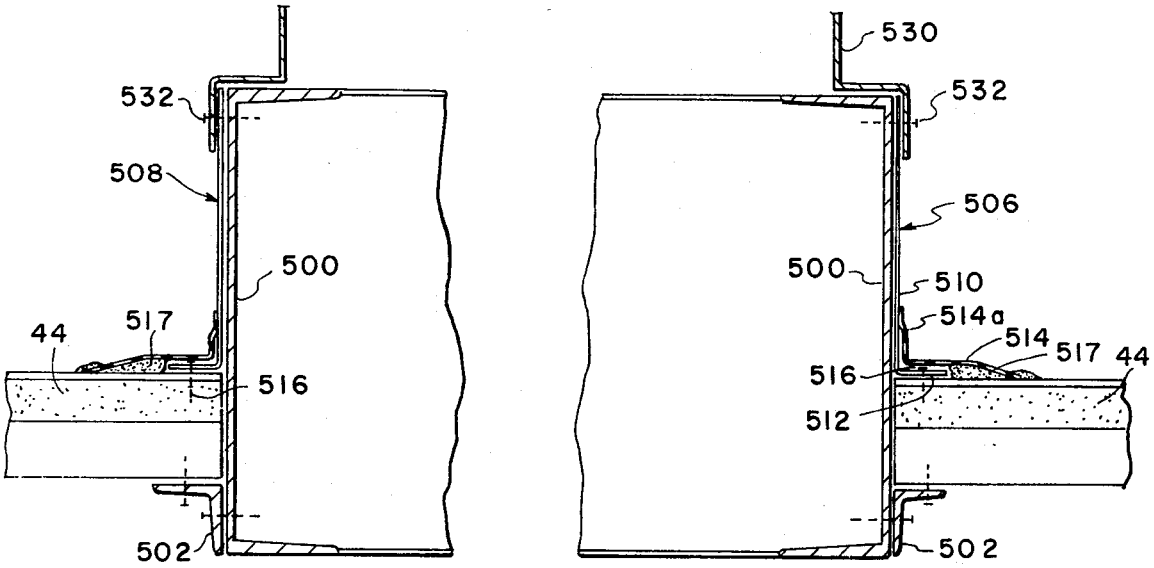
Figure 38:
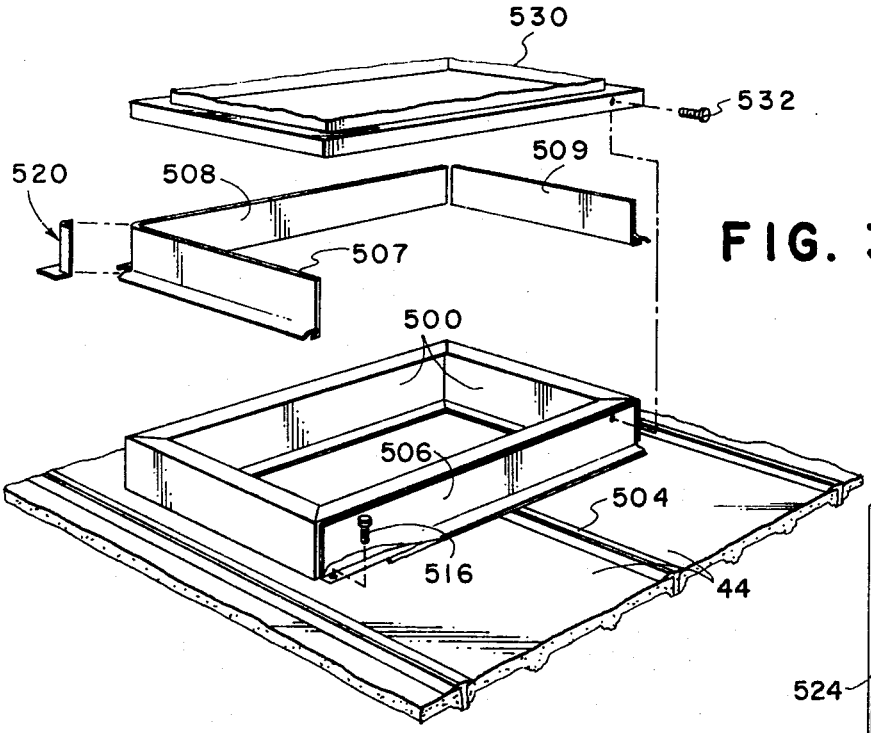
Figure 40:
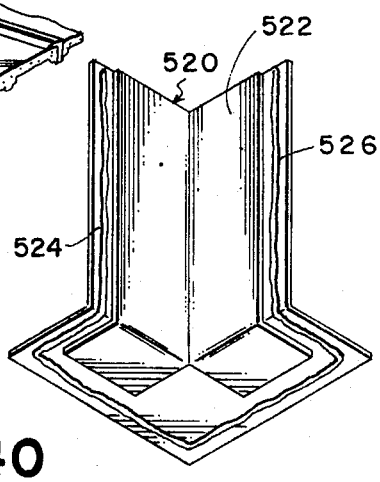

FIGS. 19A - 19D schematically illustrate the installation of the fascia corner system of FIG. 19;

FIGS. 22A and 22B schematically illustrate the assembly and installation of the fascia and gutter corner assembly of FIG. 22;

FIGS. 24, 25 and 26 illustrate splicer members for the box gutter, box fascia, and flat fascia members, respectively, in accordance with the present invention;

FIG. 27 is a sectional view taken on lines 27 — 27 of each of FIGS. 24, 25 or 26;

FIG. 28 is a transverse sectional view of the parapet flashing member illustrated in FIG. 2B;

FIG. 29 is a schematic perspective view of a parapet flashing end cap in accordance with the present invention;

FIGS. 29A - 29C are schematic illustrations of the sequence for terminating a box gutter at a corner transition to a parapet wall in accordance with the present invention;

FIG. 30 is a schemmatic sectional view of a parapet flashing installation at the end of the roof deck panels including a scupper in accordance with the present invention;

FIG. 31 is a schematic sectional view similar to FIG. 2B illustrating the parapet flashing in accordance with the present invention installed at the edge of a panel with an alternative counter flash;

FIG. 32 is a schematic perspective view of an exterior corner of the parapet flashing in accordance with the present invention;

FIG. 33 is a schematic perspective view of an internal corner of a parapet flashing in accordance with the present invention;

FIG. 34 is a schematic perspective view of a penetration flashing for a vent pipe in accordance with the present invention;

FIG. 35 is a simplified cross sectional view of the penetration flashing of FIG. 34;

FIG. 35A is an enlarged view of a portion of the sectional view of FIG. 35 to better illustrate details of construction;

FIG. 36 is a schematic perspective view illustrating a deck drain installation in accordance with the present invention;

FIG. 37 is a simplified sectional view taken substantially on lines 37 — 37 of FIG. 36;

FIG. 37A is an enlarged view of a portion of the sectional view of FIG. 37 to better illustrate details of construction;

FIG. 38 is an exploded schematic perspective view illustrating the assembly of a curb penetration flashing in accordance with the present invention;

FIG. 39 is a simplified sectional view taken substantially on lines 39 — 39 of FIG. 38, with the center section removed; and FIG. 40 is a simplified perspective of the corner member of the curb flashing system illustrated in FIG. 38.

Figure 1:
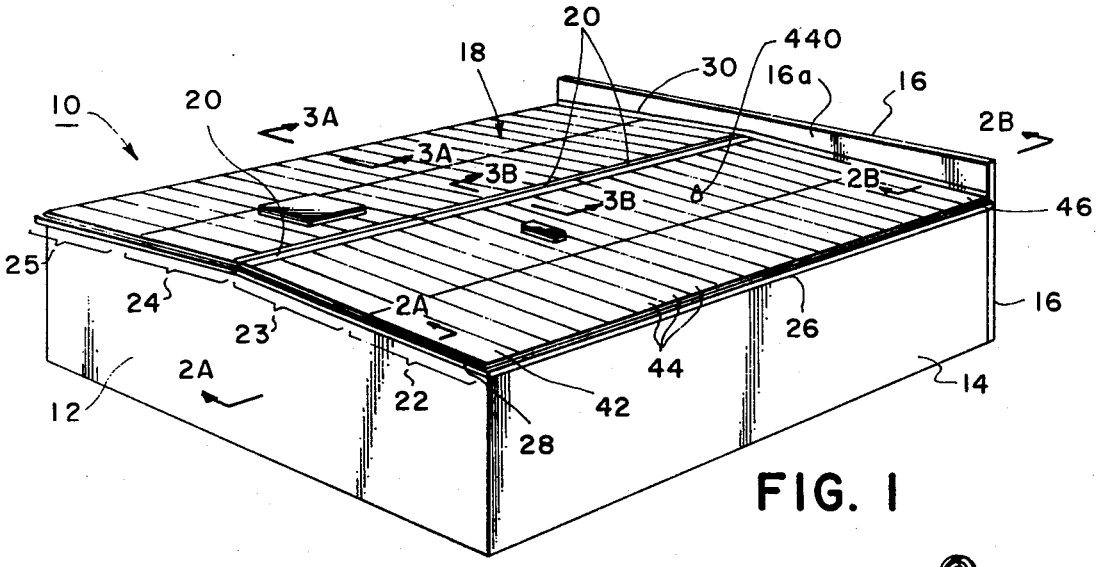
FIG. 1 is a schematic isometric view of a building in accordance with the present invention.

Referring now to the drawings, a building system in accordance with the present invention is indicated generally by the reference numeral 10 in FIG. 1. The building 10 includes walls 12 and 14 and a third hidden wall, which may be of any conventional design such as corrugated panels presently used in the preengineered steel building industry, concrete, masonry, or the like as hereafter described in greater detail. The fourth wall 16 is a typical parapet wall of masonry or concrete and includes a portion 16A which extends above a roof deck assembly indicated generally by the reference numeral 18. The roof deck assembly 10 overhangs the walls 12 and 14.

The roof deck assembly is preferably of the type described and claimed broadly in U.S. Pat. No. 3,909,998, co-pending U.S. application Ser. No. 336,364, filed Feb. 27, 1973, and more particularly preferably utilizes the panels described in U.S. application entitled PREFABRICATED WATERTIGHT STRUCTURAL SYSTEM, filed on behalf of Harold G. Simpson, on Oct. 22, 1975, all of which are assigned to the assignee of the present invention, and which are hereby incorporated by reference.

The roof deck system 18 inncludes a plurality of ridge panels 20, and four courses 22, 23, 24 and 25 of prefabricated panels 44. A box gutter 26 extends along the eaves of the first course of panels 22 and a similar box gutter 28 extends along the side edges of the four courses of panels. The parapet flashing 30 is provided between parapet wall 16 and the other side edges of the four courses of panels.

As can best be seen in FIGS. 2A and 2B, each course of panels includes a foam insulation edge filler strip 40, a starter panel 42, a plurality of conventional panels 44, a finishing panel 46, and a second foam edge filler strip 48. The starter and finishing panels 42 and 46 both are substantially narrower and have widths designed to conform to the specific dimensions of the building when combined with a predetermined number of standard panels 44. More important, however, is the fact that the starter panel 42 has a down-turned tongue and groove fastener 50 at left hand edge and an up-turned tongue and groove fastener 52 at the right hand edge, while the finishing panel 46 has a down-turned tongue and groove fasteners 54 and 56 at each edge. For purposes which will hereafter become more apparent, it is desirable for the tongue and groove fasteners at all perimeter edges of the array of panels forming the deck to face downwardly to permit forming three way corner seals as will hereafter be described in greater detail. A flat metal plate rather than a corrugated plate is provided as the bottom member of the starter and finishing panels so that different width panels can be fabricated for different length buildings. Otherwise, the panels 42 and 46 are of identical construction to the standard panels 44.

Figure 6:
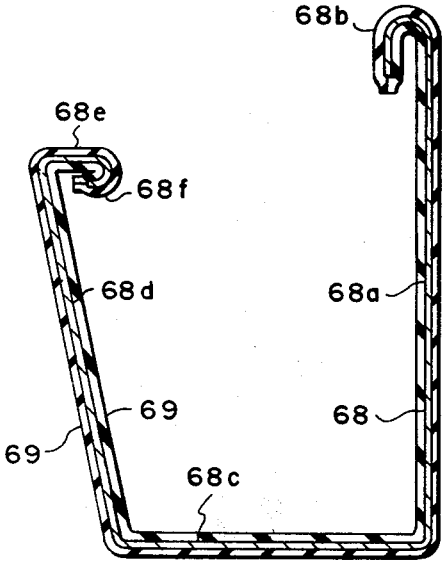
FIG. 6 is a transverse sectional view of the box gutter of the building system of FIG. 2A.
Figure 5:
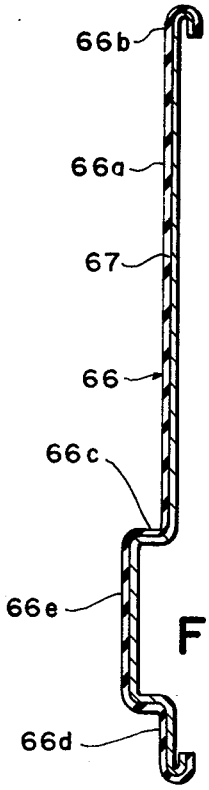
FIG. 5 is a transverse sectional view of a fascia element of the building system illustrated in FIG. 2A.
Figure 7:
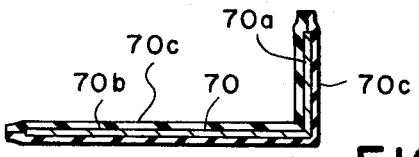
FIG. 7 is a sectional view of the box gutter hanger of the building system of FIG. 2A.
Figure 8:
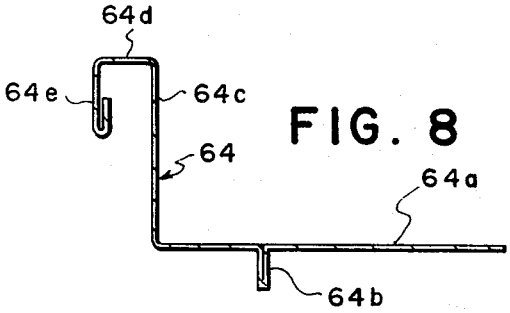
FIG. 8 is a transverse sectional view of the edge structural element of the building system of FIG. 2A.

The box gutter edge flashing assembly illustrated in FIG. 2A is comprised of five basic components, an edge membrane 60 which has an upwardly facing tongue and groove fastener 62 for mating with the down-turned tongue and groove fastener 50 on the starter panel, an edge structural member 64 which is shown in detail in the cross sectional view of FIG. 8, a standard fascia member 66 which is shown in detail in FIG. 5, a box gutter 68 which is shown in detail in FIG. 6, and a box gutter hanger 70 which is shown in detail in FIG. 7.

Figure 3B:
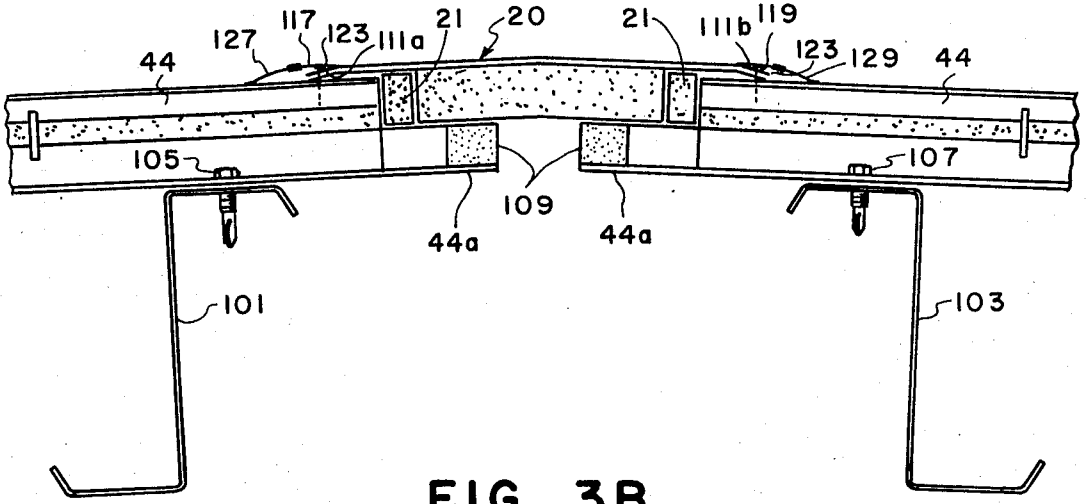
FIG. 3B is a schematic sectional view taken substantially on lines 3B — 3B of FIG. 1.
Figure 3A:
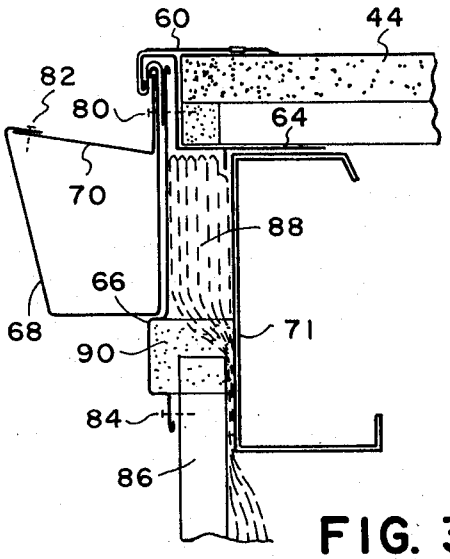
FIG. 3A is a schematic sectional view, taken substantially on lines 3A — 3A of FIG. 1.
Figure 4:
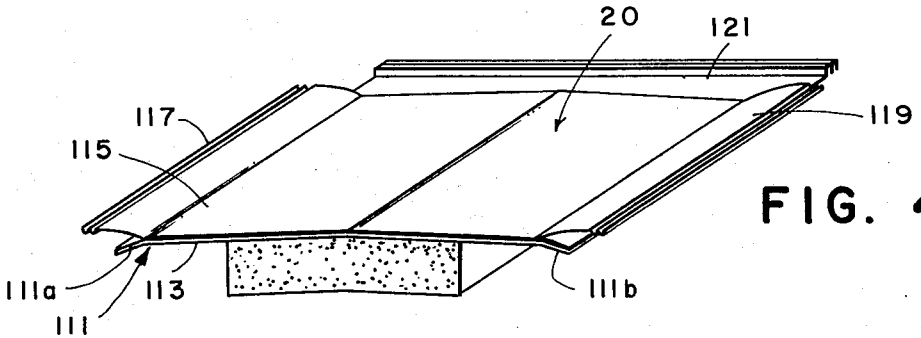
FIG. 4 is an isometric view, partially in section, of a component illustrated in FIG. 3B.

Referring to FIG. 8, the edge structural member 64 has an inward flange portion **64*a* which can be affixed to any structural member such as the ends of the purins 72, as illustrated in FIG. 2A, or the eave strut 70 as illustrated in FIG. 3A. Both the purlins and eave strut extend transversely of the panels 44. A locator tab 64*b* is formed to abut the ends of the purlin or the edge of the eave strut or other structural member to properly locate the edge structural member 64. An upright flange portion 64*c* has a height corresponding substantially to the thickness of the panels 44, an outward extending spacer portion 64*d*, and a downturned lip 64*e* having a rolled edge for stiffness. The entire edge structural member may be roll formed, or brake formed, including the tab 64*b***, from sheet metal of a guage typically used in the pre-engineered steel building industry.

The flat fascia plate 66 illustrated in FIG. 5 includes an upper vertical section **66*a* having a rolled lip 66*b*, a gutter supporting ledge 66*c*, which as will presently be described, may have varying dimensions to accommodate walls of varying thicknesses, a foam filler receiving section 66*e*, and a lower skirt portion 66*d* which overlaps the exterior surface of the wall and provides a means for fastening the fascia plate 6** to the wall where required.

The box gutter 68 illustrated in FIG. 6 has a rear vertical wall **68*a* with an open rolled edge 68*b* at the upper end, and a vertical dimension substantially equal to the upper face 66*a* of the fascia 66. A bottom wall 68*c* forms the bottom of the gutter and connects the front wall 68*b* to the rear wall. The upper edge of the outside plate 68*d* has in-turned flange 68*e* which terminates in a rolled edge 68*f***.

The gutter hanger 70 illustrated in FIG. 7 is a strap which has a near horizontal leg **70*b* corresponding to the distance from the in-turned lip 68*e* to the rear wall 68*a* of the box gutter and an up-turned leg 70*c* dimensioned to be inserted into the open rolled edge 68*b* of the box gutter so as to space the horizontal leg 70*b*** at the appropriate height.

The outer face of the fascia plate 66 may be covered by a Hypalon membrane 67 intimately bonded to the entire surface by an epoxy or similar adhesive to achieve good corrosion resistance as described in the above referenced application. Simultaneously, either or both surfaces of the box gutter 68 may be covered with a Hypalon membrane, as represented by the membrane 69, as can the hanger strap 70, to provide total corrosion resistance. The membranes 69, for example, preferably extend beyond the edges of the metal and are bonded together to totally incorporate the engaged surfaces of the metal. Or the surfaces of the members 66, 68 and 70 may be finished with paint to match the wall panels if desired.

Figure 9:
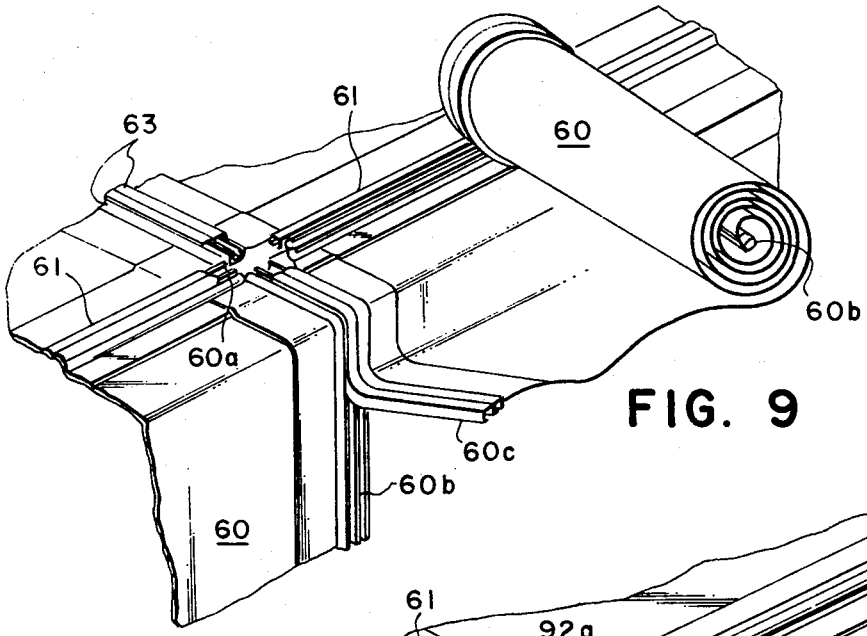
FIGS. 9, 10 and 11 are schematic illustrations showing how the membrane edge panel of the building system of the present invention is installed, including the arrangement of the fastener halves at a corner junction in preparation for a corner seal.
Figure 10:
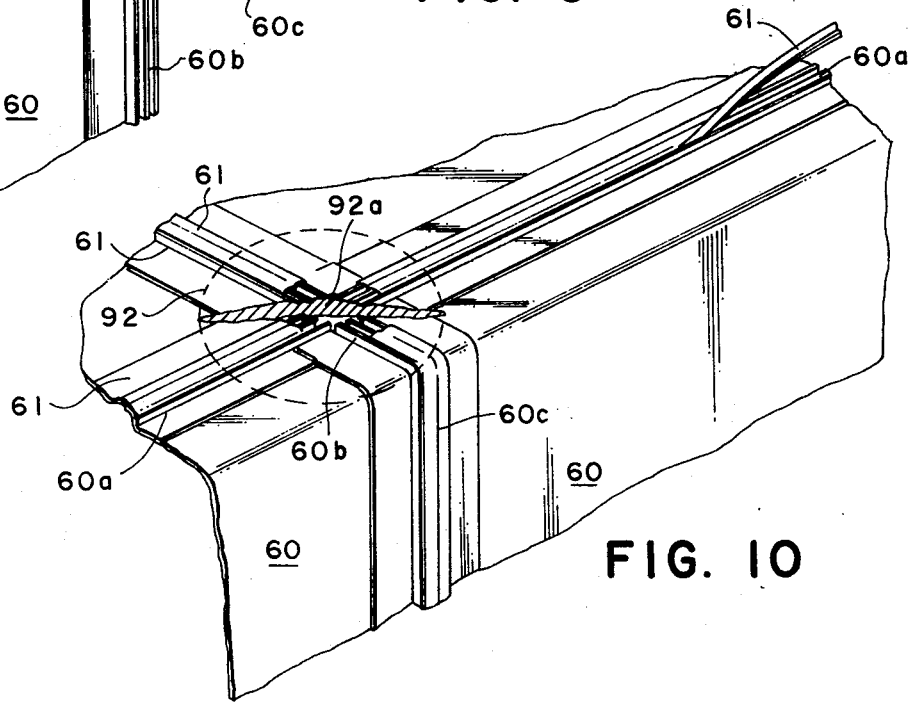
Figure 11:
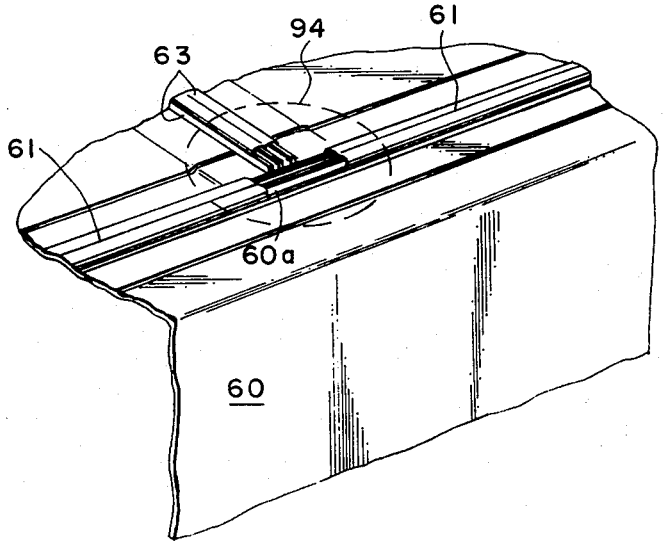

The membrane edge panel 60 is best illustrated in FIGS. 9 – 11. Each edge membrane includes an upwardly facing tongue and groove strip fastener **60*a* along the long edge which is adapted to mate with corresponding downwardly facing strip fasteners 61 at the edge of each of the panels disposed around the edge of the array of panels of the roof deck assembly 18. The membrane 60 is preferably a double thickness of colandered Hypalon material laminated on each side of a nylon mesh fabric (not illustrated). The fabric provides additional tensile strength, yet permits substantially full flexure of the material, and this laminated material is commercially available for various applications. The membrane panel 60 includes an outwardly looking tongue and groove fastener member 60*b* along one end, and an inwardly looking tongue and groove fastener 60*c* along the opposite end, as is best illustrated in FIG. 9**.

Figure 12:
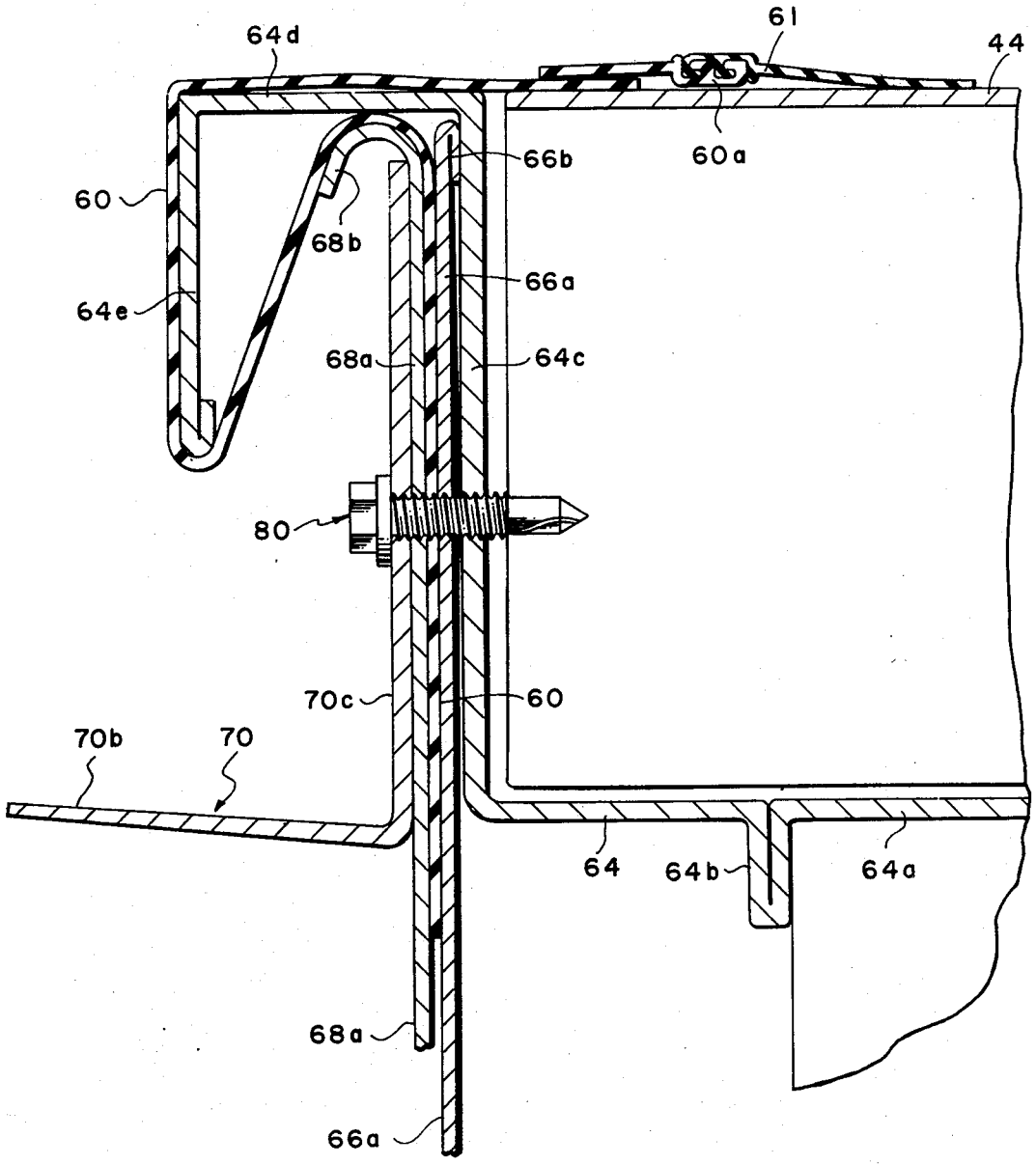
FIG. 12 is an enlarged sectional view illustrating a portion of the assembly illustrated schematically in FIG. 3A.
Figure 13:
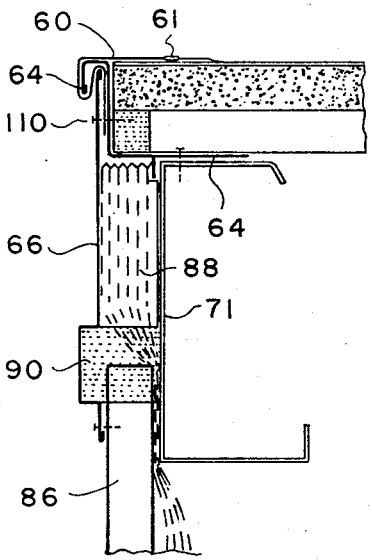
FIG. 13 is a schematic sectional view illustrating installation of a flat fascia without a box gutter in accordance with the present invention.

The elements of the edge flashing system are installed as best seen in FIGS. 2A, 3A and 12. The edge structural member is positioned transversely across the ends of the purlins 72 as illustrated in FIG. 2A or along the edge of the eave strut 70 as illustrated in FIG. 3A. The edges of the panels of the roof assembly are abutted against the upright flanges **64*c* of the edge structural member 64. The Hypalon membrane flashing panels 60 are then engaged with the Hypalon membrane of the panel system by the engaged zippers 60*a* and 61. The upper vertical plate 66*a* of the fascia is disposed adjacent the vertical flange 64*c* of the edge structural member 64 with the rolled edge 66*b* abutting the portion 64*d* of the edge member. The Hypalon edge panel 60 passes around the rolled edge of the down-turned flange 64*e*, passes up over the top of the rolled edge 68*b* of the box gutter rear wall, and then extends downwardly between the rear wall 68*a* of the box gutter and the upper panel 66*a* of the fascia plate. The upright leg 70*c* of the strip hanger 70 is disposed against the back wall 68*a* of the box gutter and a self-drilling and self-tapping hex-head fastener 80 drilled through and tapped into the sheet metal parts 70*c*, 68*a*, the Hypalon panel 60, and the sheet metal members 66*a* and 64*c*. As previously mentioned, the ledge 66*c* of the fascia plate 66 is positioned to support the bottom 68*c* of the box gutter when the upper ends 66*b* and 68*b* are in the position illustrated in FIG. 12. As can best be seen in FIGS. 2A and 3A, a suitable self-drilling fastener 82 connects the outer end of the leg 70*b* of the gutter hanger 70 to the in-turned lip 68*e* of the box gutter. Self-drilling fasteners 84 may also be used to connect the lower flange 6*d* of the fascia plate to the wall panels 86 as represented in the schematic drawings of FIGS. 2A and 3A. It will be noted that insulation 88 is provided between the fascia plate 66 and the ends of the purlin 72 in FIG. 2A and the eave strut 70 in FIG. 3A, and that the upper ends of the wall panels 86 are preferably closed by a closed cell foam rubber strip 90 when the panels 86 are corrugated. Similarly, as illustrated in FIG. 3A, the corrugations of the bottom of the standard roof panels 44 are closed by closed cell foam rubber strip 91, as illustrated in FIG. 13** presently to be described.

The ridge section of the roofing system of FIG. 1 is formed as illustrated in FIG. 3B. The upper ends of the panels 44 in courses 23 and 24 as shown in FIG. 3B are supported on purlins 101 and 103 with the edges fastened down by fasteners 105 and 107, respectively. The end lips 44*a* formed by extensions of the corrugated lower metal panels are closed by closed cell foam rubber fillers 109. A plurality of ridge panels 20, are then placed end to end, each in the position as illustrated in FIG. 3B, with foam ridge filler panels 21 disposed on each side of the ridge panel 20.

Each ridge panel 20 comprises a laminated member 111 comprised of a thin sheet steel layer 113 and a Hypalon membrane layer 15 intimately bonded to the entire surface of the sheet steel. The edges 111*a* and 111*b* of the member 111 are slightly down-turned as illustrated to ensure contact with the top surface of the panels of courses 23 and 24, and extend well beyond the ends of the panels 44 to provide for discrepancies in building widths by trimming the width of the ridge filler panels 21. Extruded Hypalon strip fasteners 117 and 118*a*, both of which are upwardly facing, have webs which are bonded to the Hypalon layer 115 at points inset from the edges 111*a* and 111*b*. Similar strip fasteners are provided at each end of the ridge panel 20, although only one fastener 121 is shown in FIG. 3C. The ridge panels 20 are installed by placing them in position as illustrated, and fastening the lips 111*a* and 111*b* to the surface of the underlying panels 44 and using self-drilling fasteners 123. Then the Hypalon strip fasteners 117 and 119, as well as the end strip fasteners including fastener 121, are mated with the adjacent fastener halves 127 and 129 on the adjacent panels 44 and with the fastener halves on the adjacent ridge panels 20. Then the corner seals are closed as herein described using a suitable dissolved Hypalon mixture, or other suitable seal.

The installation of the box gutter and flashing system illustrated in FIGS. 2A and 3A is best understood from FIGS. 9 – 12. The edge structural member 64 is first installed around the edge of the building to outline the array of roof panels. The roofing panels are then placed in position with the ends abutting the edge structural member 64, as illustrated, for example, in FIG. 3A, and with the edge fillers 40 at the end of each course of panels disposed adjacent the member 64 disposed across the ends of the purlins 72. This provides a series of interrupted downwardly facing tongue and groove fastener halves around the periphery of the building. A number of membrane edge panels 60 are then sequentially unrolled along each edge of the roof and the adjacent fastener halves 60*a* and 61 and the fastener halves 60*b* and 60*c* engaged as illustrated in FIGS. 9, 10 and 11. As a result, skirts of the edge membrane panels 60 hang down along the edge of the roof assembly. It will be noted from FIG. 10 that four pairs of fastener halves terminate at a common corner as best illustrated in FIG. 10. As can best be shown in FIG. 10, the upwardly facing tongue and groove fastener halves protrude beyond the ends of the downwardly facing fastener halves so that a suitable Hypalon paste-like mixture may be applied in the area 92 to a thickness represented by the cross hatched profile 92*a* to effectively seal all capillary paths extending longitudinally of the engaged fastener strips. FIG. 11 illustrates a three way joint where the upwardly looking fastener half 60*a* on the Hypalon membrane edge panel 60 faces upwardly and the downwardly facing fastener half 61 on adjacent panels provide an interruption which registers with the engaged side fasteners 63 of the adjacent roof panels. As a result, the Hypalon paste may be applied over the ends of the three downwardly facing fasteners and into the upwardly facing fastener halves in the area 94 to form a complete seal.

At any time during the assembly of the box gutter system shown in FIGS. 2A, 3A and 12, the fascia plate 66 may be secured in position by inserting the lower fasteners 84 through the lower flange portion 66*d*. The box gutter hanger strips 70 may then be connected to the lip of box gutter 68 by the fasteners 82 and the box gutter and fasteners pushed into the position illustrated with the respective Hypalon edge panel 60 extending around the top edge of the box gutter rear wall and then down between the box gutter 68 and the fascia plate 66*a*, with the bottom 68*c* of the box gutter resting on the ledge 66*c* of the fascia plate. Then the fasteners 80 are drilled through and tapped into the combined sandwich of plates as illustrated in FIG. 12. Additional fasteners 80 are preferably placed between the gutter hanger strips 70 as desired.

Figure 14:
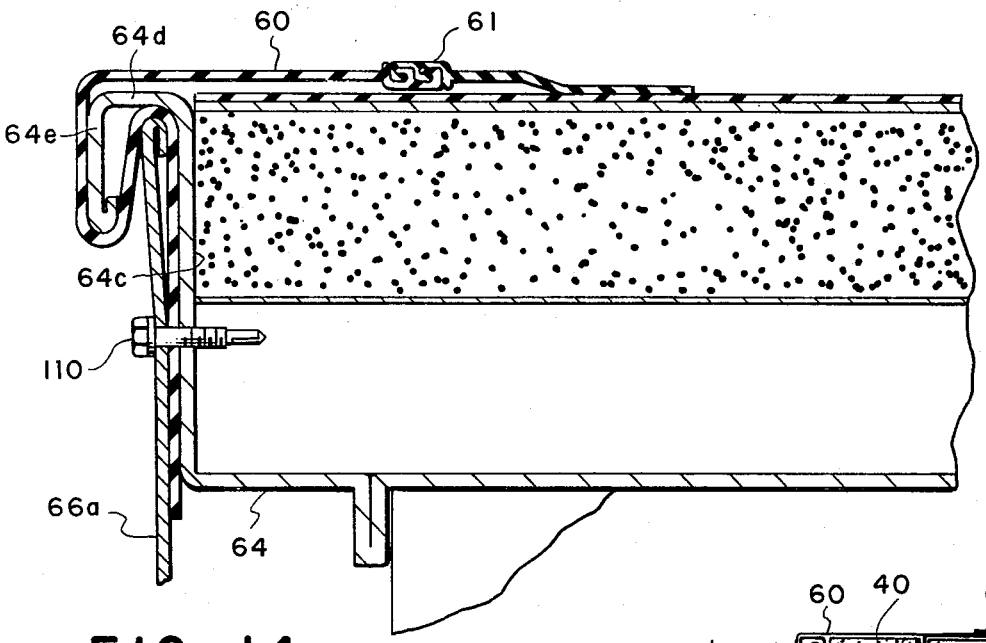
FIG. 14 is an enlarged sectional view of a portion of the structure illustrated schematically in FIG. 13.

FIGS. 13 and 14 illustrate the installation of the edge flashing system of the present invention where the box gutter is not employed. In this case, the edge structural member 64 is installed on the eave strut 70, or purlin, as the case may be, as previously described. The Hypalon edge panel 60 is then engaged with the appropriate fastener half 61 on the adjacent panel before the fascia plate 66 is placed in position. The fascia plate is then placed in position as best illustrated in FIG. 14 with the Hypalon membrane edge panel 60 behind the upper panel 66*a* of the fascia plate. The self-drilling and tapping fastener 110 is then passed through the panel 66*a* of the fascia plate through the Hypalon edge panel 60 and through the vertical flange 64*c* of the edge member as illustrated in FIG. 14. The remainder of the installation if identical to that previously described in connection with FIGS. 2A and 3A, and accordingly corresponding components are designed by the same reference numerals.

Figure 17:
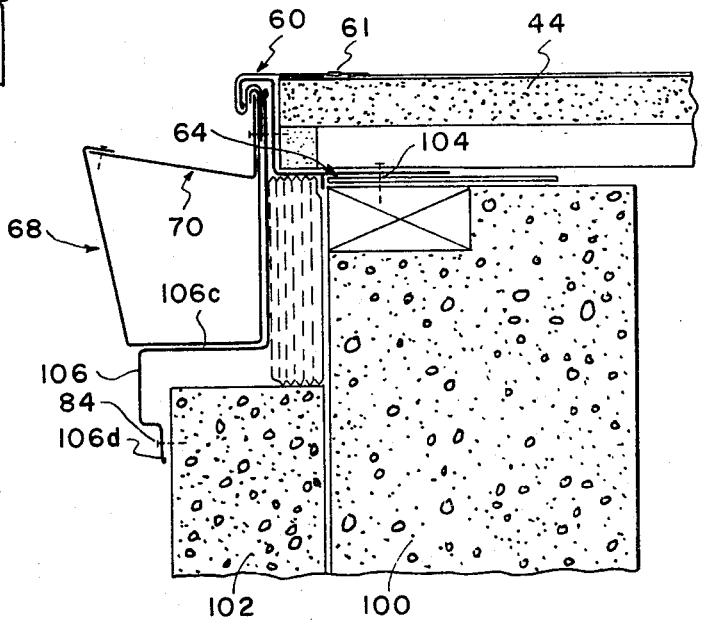
FIG. 17 is a schematic sectional view showing a box gutter installation at the ends of the panels on a conventional concrete wall in accordance with the present invention.

FIG. 17 illustrates the manner in which edge flashing system with the box gutter can be applied to a conventional concrete or masonry wall structure including a concrete support beam 100 and a masonry wall 102. The edge structural member 64 is fastened to the top of concrete structural member by a fastener 104. The fascia plate 106 may be identical to the fascia plate 66 except that the horizontal extending box gutter support ledge 106*c* extends outwardly a sufficient distance to position the skirt 106*d* on the outer face of the wall 102. The remainder of the structure, including the sequence of erection, is identical to that previously described and accordingly corresponding components are designated by the same reference numerals.

Figure 15:
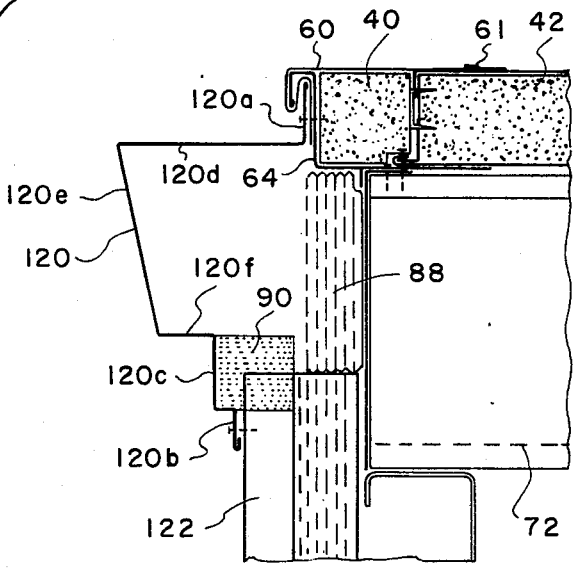
FIG. 15 is a schematic sectional view illustrating a box fascia installation in accordance with the present invention.
Figure 16:
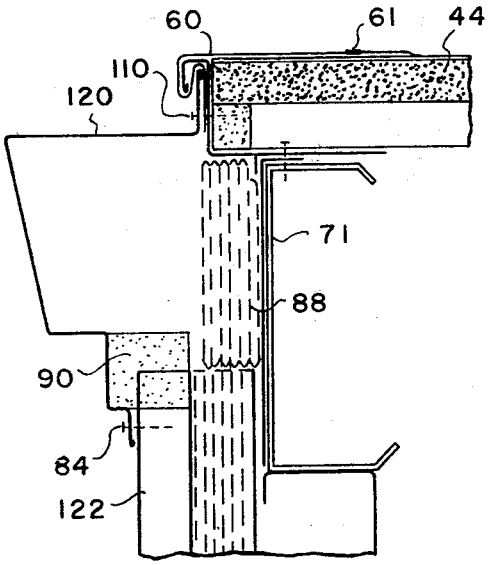
FIG. 16 is a schematic drawing similar to FIG. 15 illustrating the box fascia installation at the edge structure of a building in accordance with the present invention.
Figure 18:
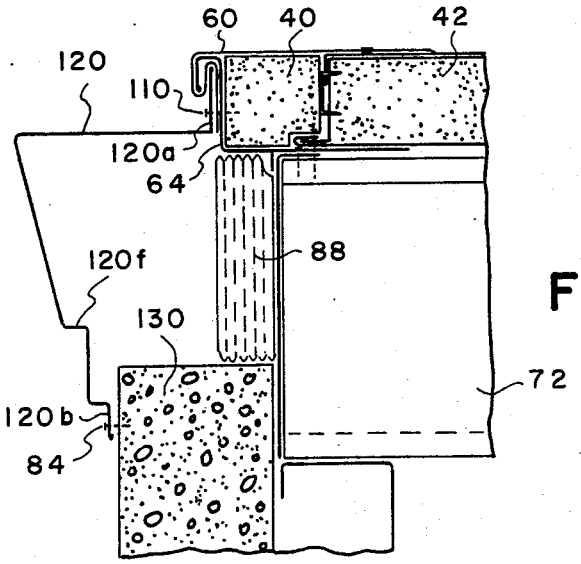
FIG. 18 is a schematic sectional view illustrating a box fascia installed at the side edge of the panels on a conventional concrete wall in accordance with the present invention.

FIGS. 15, 16 and 18 illustrate the use of a box fascia plate 120 which has a cross sectional configuration substantially corresponding to the box gutter 68 to provide structural continuity for aesthetic purposes as will presently be more evident. The box fascia 120 has an upper panel section 120*a* which functions in the same manner as panel section 66*a* of fascia plate 66, and a bottom skirt plate 120*b* which functions in the same manner as the skirt plate 66*b*. Simmilarly, foam closure retainer section 120*c* performs the same function as the retainer section 66*e*, which is to retain the foam wall closure strip and to provide additional structural rigidity. However, the fascia plate 120 has outwardly extending panel 120*d* and downwardly and inwardly extending panel 120*e* and inwardly extending panel 120*f* for the interconnection between the upper panel portion 120*a* and the skirt portion 120*b*. The installation illustrated in FIG. 15 shows the use of the box fascia 120 at the edge of the roof assembly and in connection with a conventional insulated corrugated panels 122 which are of greater thickness than previously described panels 86. The installation is otherwise identical to that illustrated in FIGS. 13 and 14 and accordingly corresponding components are designated by the same reference numerals.

FIG. 16 illustrates the installation of the box fascia 120 at the eave of the roof assembly, and corresponding reference complements are accoringly designated by the same reference characters.

FIG. 18 illustrates the use of box fascia 120 in connection with a concrete or masonry wall 130. It will be noted that the dimension of the inwardly directed panel portion 120*f* has been modified so as to accommodate a wall of greater thickness. Otherwise, except for the elimination of the foam closure 90 for corrugations, the installation is identical to that of FIG. 15 and corresponding components are therefore designated by the same reference characters.

The box gutter 68, the box fascia plate 120, and the flat fascia plate 66 may each be spliced using members 140, 142, and 144, respectively, as illustrated in FIGS. 24, 25 and 26, respectively. Each of these splicing members has substantially the same cross sectional configuration as the members to be spliced, except being slightly oversized to telescopingly receive the spliced members in close sliding relationship. Each of the splicing elements 140, 142, and 144 has the same cross sectional configuration except at the breaks, and this cross section is illustrated in FIG. 27. As can be seen in FIG. 27, the element 140, for example, includes an internal clamp plate 146 having a center web 146*a* fastened to the flat plate 148 which is bent to form the exterior configuration of a splicing element 140. The clamp plate 146 has a cross sectional configuration such as to form a pair of oppositely directed receiving pockets 150 and 151 which are sized to closely receive the ends of adjacent box gutters 68, in the example. Before assembly of the splicing element 140 with the box gutter 68, the pockets 150 and 151 are preferably substantially filled with a suitable conventional paste-like sealant. As a result, the box gutters, box facsia and plate facsia can be interconnected to form systems of substantially any length.

Corner joints for all edge flashing components and combinations thereof are illustrated in FIGS. 19 – 23. Each of these corner joints includes a corner cap 160, which is common to all five installations. A standard fascia corner member 162 is used in the configuration of FIGS. 19 and 21, and a box fascia corner member 164 is used in the installations of FIGS. 20, 22, and 23, as will presently be described. The flat corner fascia member 162 is comprised of two formed sheets having the same cross section as the splicer 144 mitered to form a ninety degree joint. Similarly, the box fascia corner 164 is comprised of two formed sheets having the same cross sectional configuration as the exterior plate of the splicer 142 which are interconnected at a ninety degree miter joint. The installation of the cap 160 and the plate fascia corner 162 is illustrated schematically in FIGS. 19A – 19D. Similarly the installation gutter of the box fascia corner 164 to form a box gutter-to-box fascia corner is illustrated in FIGS. 22A and 22B.

Figure 19A:
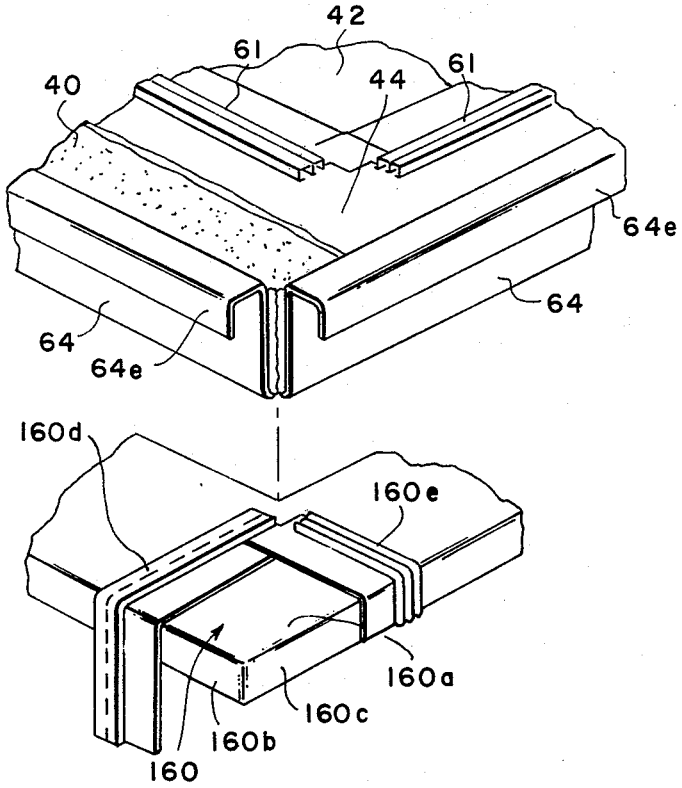
Figure 19D:
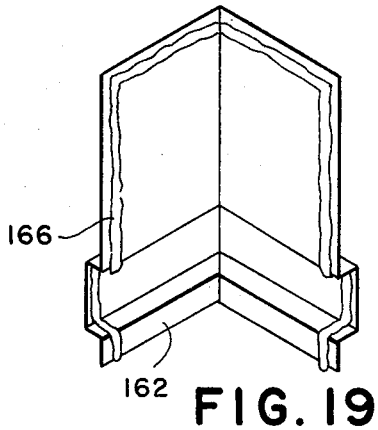
Figure 19B:
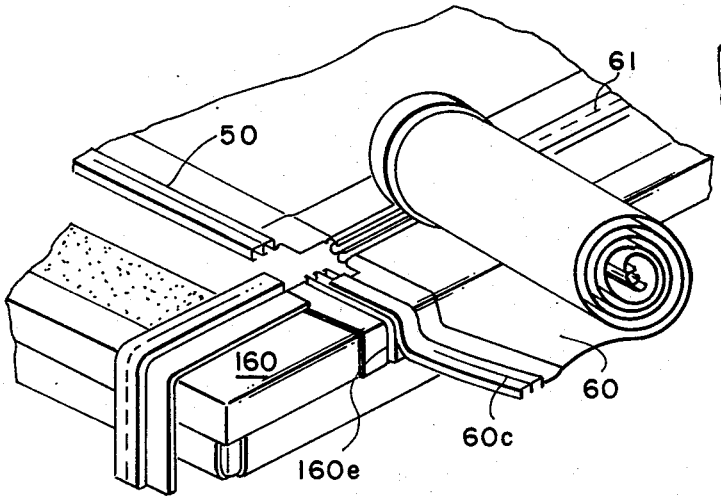
Figure 19C:
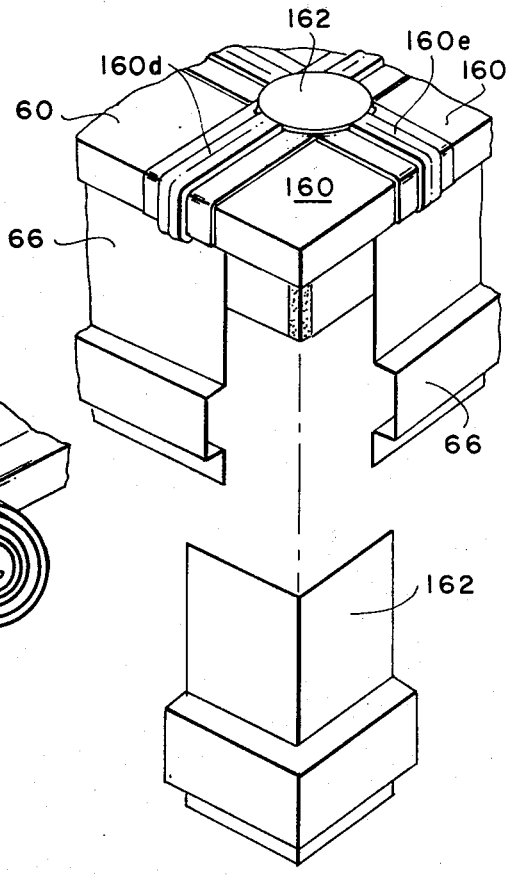

Referring first to FIGS. 19A – 19D, it will be noted that the corner cap 160 is comprised of a rectangular piece of metal 160*a* having dependent side flanges 160*b* and 160*c* on the outside two edges, all of which are covered with a Hypalon membrane continuously bonded to the metal sheet. A downwardly facing tongue and groove strip fastener 160*d* is disposed along one edge of the membrane and an upwardly facing tongue and groove fastener 160*e* is disposed along the other edge. The cap 160 is placed over the ends of the two structural edge members 64 which meet at the corner of the building with the dependent flanges 160*c* and 160*b* abutting against the down-turned flanges 64*e* of the structural edge members. In this position, it will be noted that the cap 160 is positioned over the corner of the starter panel 42, for example, and over the end of the filler strip 40 at the edge of the panel 42 with the fastener half 160*d* aligned with the fastener half 61 at the end of the panel 42 and with fastener half 160*e* substantially aligned with the fastener half 50 on the edge of panel 42, as illustrated in FIG. 19B. The zipper 60*c* of an edge membrane panel 60 is then mated with the zipper 160*e* and the zipper 160*d* mated with upwardly facing zipper 60*b* of another membrane panel 60. The four-way corner is then closed by a mass 162 of sealing material as previously described. The fascia plates 66 are then installed as described in connection with FIGS. 13 and 14, resulting in the structure illustrated in FIG. 19C. Then a bead of sealant 166 is applied along the edges of the interior face of the fascia corner member 162 substantially as illustrated in FIG. 19D, and corner member 166 applied in the manner illustrated in FIG. 19C to produce the corner as illustrated in FIG. 19. Suitable self-drilling fasteners 168 are then inserted through the panels to secure the corner member in place.

Figure 23:
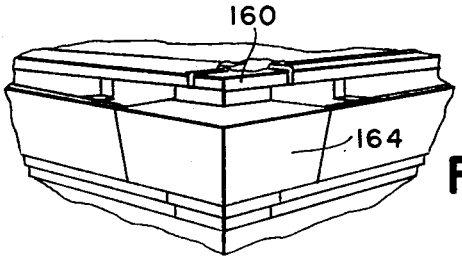

The assembly of the box gutter to box fascia corner illustrated in FIG. 22 is illustrated in FIGS. 22A – 22B. The corner cap 160 is installed as previously described in connection with FIGS. 19A and 19B. The box fascia plate 120 is installed as described in connection with FIGS. 15 and 16. The standard fascia plate 66 and box gutter 68 are installed as previously described in connection with FIGS. 2A, 3A and 12. Additionally, the end of the box gutter 68 is closed by means of a dam member 170 which has a configuration corresponding to the cross sectional configuration of the box gutter 68 with sealing flanges 170*a* along each of the four edges. The dam member 170 is installed in the box gutter by applying a mastic to the flanges 170*a* which engage the box gutter and then installing fasteners 172 to secure the end member in place, preferably before the gutter is hung on the fascia plate. After the box gutter 68 is installed as illustrated in FIG. 22, a bead of sealant 174 is applied along the line where the box fascia corner member 164 will contact the structure. In this connection, it will be noted that the edges 164*a* are cut back from the edges 164*b* to accommodate the fasteners 172 previously inserted to hold the closure member 170 in place. A similar bead of sealant 176 is applied to the box fascia 120 and the box facia corner 164 applied to the position illustrated in FIG. 22B. Fasteners 178 are then applied to hold the box fascia corner member 164 in place. Of course, it will be appreciated that the box fascia can be applied in the same manner to form the box fascia-to-box fascia transition illustrated in FIG. 20 or the box gutter-to-box gutter transition illustrated in FIG. 23. In the latter case, dam members 170 are provided at the ends of both gutters as illustrated in FIG. 23 to provide a continuous gutter extending around the corner of the building.

The parapet flashing strip 30 of FIG. 1 is schematically illustrated in FIG. 2B, and in detail in the transverse cross sectional view of FIG. 28. The parapet flashing plate 30 is comprised of a strip of sheet metal 232 to which is continuously bonded a sheet of Hypalon 234 in the manner described in the above referenced co-pending applications. Upper portion **30*a* of the panel 30 is disposed vertically against the parapet wall and extends to whatever height is required to exceed the maximum design water level on the roof. In the installation illustrated in FIG. 1, water cannot stand on the sloping roof and, accoringly, the height can be relatively minimal. The parapet flashing plate 30 has a transitional section 30*b* and a lower connection flange 30*c*. The lower connection flange 30*c* preferably has a rolled edge 30*d* to provide a stronger flange for receiving fasteners as will presently be described. An extruded Hypalon fastener half 236 has a downwardly facing tongue and groove fastener portion 236*a* and a web portion 236*b* which is connected only along a weld seam 236*c* along the upper edge to the Hypalon sheet 234**.

Referring once again to FIGS. 2B and 28, the flashing strip 30 is positioned so that the connection flange **30*c* is placed on the flat upper surface of the finishing panel 46. The transitional section 36*b* extends over the edge filler 48 and the upper section 30*a* rests against the parapet wall 16 and is positioned under a reglet 240 which is imbedded in the parapet wall 16 in the conventional manner. Self-drilling fasteners 242 pass through the rolled edge portion of the flange 30*c* and into the surface sheet of the finishing panel 46. The upper end of the parapet flashing 30 is secured by the reglet so that no penetration of the flashing strip 30 occurs except under the strip fastener 236. After the self-drilling fasteners 242 are inserted, the strip fastener half 236*a* is mated with the fastener half 56 on the transitional panel 46 to establish the watertight seal. Each end of the parapet flashing strip 30 is provided with a strip fastener half bonded to the Hypalon sheet 234 in substantially the same manner as the fasteners 60*b* and 60*c* previously described on the edge membrane panel 60, as will presently be evident in the description of FIGS. 30, 32 and 34**.

Each end of the parapet flash 30 is terminated by a parapet flash end cap indicated generally by the reference numeral 250 in FIG. 29. The parapet flash end cap 50 has a first section **250*a* which corresponds in configuration to the parapet flash trip 230. A triangularly shaped end panel 250*b* includes a depending flange 250*c*. A rear face 250*d*, as best seen in FIGS. 29A and 29C, closes the back of the cap. The entire cap 250 is formed of sheet metal laminated with a layer of Hypalon in the same manner as the flashing strip 30 and includes either a downwardly facing fastener strip half 260, as illustrated in FIG. 29, or an upwardly facing fastener half similar to fastener half 160*e* on the corner cap 160 as illustrated in FIG. 19A**, depending upon which end of the parapet the cap is to be placed.

The parapet flash end cap 250 is installed together with a box fascia corner member 164 to complete the end of the gutter 26 using the procedure illustrated schematically in FIGS. 29A - 29C. After the membrane edge panel 60 is installed as illustrated in FIG. 29, the standard fascia plate 66 and box gutter 68 are installed with an dam member 170 installed as previously described in connection with FIGS. 22A and 22B, in the position illustrated in FIG. 29A. Then the box fascia corner member 164 shown in FIG. 29B is trimmed along the dotted line 270 which is determined by the location of the end of the parapet wall to the panel wall. Then either the interior surface of the member 164 or the box gutter structure is caulked with a suitable sealant bead 272 as illustrated in FIG. 29A and the trimmed member 164 applied as illustrated in FIG. 29C. Suitable fasteners 276 are then drilled in to secure the member 164 in place, and finally a caulking bead 278 applied to seal the joint between the member 164 and the end of the parapet wall 16 as illustrated in FIG. 29C.

An exterior corner for the parapet flash is indicated by the reference numeral 300 in FIG. 32. As illustrated, the corner occurs at the juncture of three stamdard panels **44*a*, 44*b* and 44*c*. The parapet corner member 300 has two sections having a cross section identical to that illustrated in FIG. 28 with a miter connection 302 to form the appropriate angle, typically ninety degrees. Hypalon strip fastener halves 304 and 306 are disposed at the ends of the corner member 300, and fastener halves 308 and 310 are provided at the lower edge, both upwardly looking, for mating with the downwardly looking strip fastener 61 of the panels 44*a* and 44*c*. The strip fasteners 304 and 306 mate with strip fasteners 237 and 239 at opposite ends of the flashing strips 30. Because of the fact that the strip fasteners 61 are downwardly facing, the fastener strips must be cut open to expose the ends of the upwardly facing fasteners 236, 308, 310 before the sealing material is applied to form the junction seals 312 and 314. A conventional arrangement of strip fastener ends is provided for the junction seal 316**.

An internal corner for the parapet flash is provided by the parapet flashing corner member 320 in FIG. 33. The corner member 320 is comprised of two portions **320*a* and 320*b* which are of identical cross sectional configuration and composition as that illustrated in FIG. 28 and which are interconnected at a miter joint 320*c*. Additionally, Hypalon strip fastener halves 322 and 324 are bonded along the opposite edges of the member 320. These are mated with the end fastener members 237 and 239 of parapet flashing strips 30 as illustrated in FIG. 33. A single corner seal 326 is formed at the junction formed by the mating of the eight strip fastener halves which are arrayed in the manner illustrated in FIG. 10**.

A scupper opening parapet flashing member is indicated generally by the reference numeral 400 in FIGS. 30 and 31. The scupper opening member is positioned at the down slope end of panels 44 and provides a means for water drainage through a parapet wall 402. The scupper opening is a four sided chute 404 which is connected to a corresponding opening in a parapet flash plate 406 having the identical cross sectional configuration and composition as that illustrated in FIG. 28. The scupper chute 404 is also laminated with a continuous membrane of Hypalon which coats the interior surface of all four walls of the chute. The web of an upwardly facing strip fastener 408 is bonded to the Hypalon laminated to the surface of the bottom panel 404a of the chute. Strip fastener halves 410 and 412 are provided at each end of the parapet flashing plate 406 to mate with the strip fastener halves 237 and 229 of parapet flashing strips 30 at either edge. The bottom wall plate of the scupper chute is a continuation of the bottom flange of the flashing plate which is fastened to the panel 44 by a self-drilling fastener 416 disposed under the engaged fastener halves 408, 61 as heretofore described in connection with the parapet flash members 30. Corner seals 420 and 422 are formed by cutting the downwardly looking fastener half 61 away to reveal the upwardly looking fastener halves 236 and 408.

An upstanding penetration flashing, such as is provided for a vent pipe, is indicated generally by the reference numeral 440 in the schematic illustration of FIG. 34 and in the detailed sectional view of FIG. 35. As illustrated in FIG. 35, an opening 442 is cut in a standard panel 44. The upright penetration flashing includes a conical member 444 formed of a sheet metal 446 to which a Hypalon membrane 448 is intimately laminated as heretofore described. The conical member 444 is connected to a metal collar 450 by soldering or other suitable means to provide a peripheral metal connection lip 462 which may rest on the top surface of the panel 44 around the opening 442. An annular collar 454 of Hypalon is thermally welded along weld seam 456 to the Hypalon membrane 448 and extends beyond the outer edge of the connection lip 462. A cone shaped cap 458 covers the open end of the frustoconically shaped member 444 and is supported by brackets 460 secured in any suitable manner, such as by fasteners 462, to the outside of the member 444, and also to the outside of vent pipe counterflashing extending over the outside of member 444 when it is desired to seal around the vent pipe or other penetration.

The penetration flashing 440 is installed by raising the flap 454 as illustrated in FIG. 34 and then inserting self-drilling fasteners 462 through the metal lip 452 at peripherally spaced points. A bead of Hypalon paste 455 is then laid down on the Hypalon surface of the panel around the lip 452. The Hypalon flap 454 is then pressed down against the Hypalon paste so that the paste is extruded from beneath the flap 454 to complete the seal. It is desirable to provide sufficient Hypalon paste so that the excess material can be troweled to slightly cover the very edge and part of the top surface of the Hypalon flap to ensure a good mechanical connection and watertight seal, as illustrated in FIG. 35A.

A deck drain flashing system in accordance with the present invention is indicated generally by the reference numeral 480 in FIGS. 36 and 37. As can best be seen in the sectional view of FIG. 37, a square pan structure is formed of sheet metal laminated with Hypalon and having a bottom wall 482, side walls 483, 484, 485 and a fourth which is not visible in the drawings, and a peripheral lip 486 extending along each edge of the four side walls of the pan. A conventional drain assembly comprised of a strainer cap 490 and a drain pipe 492 have flanges 490a and 492a which sealingly clamp the bottom wall 482 of the pan around the periphery of an opening (not illustrated) in the bottom wall. A flexible Hypalon flap 494 is bonded around the interior edge to the Hypalon member coating the peripheral lip 482 of the pan and extends beyond the exterior edge of the lip. An opening 496 is formed in the roof panel 44 and is sized such that the peripheral lip 482 will rest on the surface of the panel 44 around the periphery of the opening 496. The flashing 480 is installed in exactly the same manner as the flashing member 440. After fasteners 498 are used to connect the lip to the panel 44, the paste of dissolved Hypalon compound is applied around the peripheral lip 486 to then bond the outer lip of the Hypalon flap 494 to the Hypalon surface of the panel 44, as illustrated in FIG. 37A.

Thus it will be noted that the penetration flashing 440 for vent pipes and similar penetrations of the roof provides a continuous waterproof Hypalon membrane to a point above the level at which water is designed to stand on the roof of which the panel 44 is a part. Similarly, the drain flashing member 480 provides a continuous unpenetrated Hypalon membrane from the surface of the panel 44 to the peripheral seal provided by the drain flanges 490a and 492a.

A structurally supported curb penetration of the roof membrane is schematically illustrated in exploded form in FIG. 38 and in the detailed sectional view of FIG. 39. As can best be seen in FIG. 39, the penetration curb is formed by four channel iron members 500 which are interconnected to form a rectangular box. The beams 500 are supported by suitable structural members not illustrated. Angle iron membranes 502 are connected to the webs of beams 500 to support the edges of the panels 44 which have been cut to conform to the curb. It will be noted from FIG. 40 that the curb beams transversely intersect a strip fastener joint 504 between two adjacent panels 44. Four curb flashing panels 506 - 509 are provided as facing for the webs of the channels 500 and each comprises a sheet metal web 510 having an outturned lip 512, both of which are covered with a Hypalon membrane as heretofore described. A flexible Hypalon flap 514 is welded along edge 514a to the Hypalon membrane of each of the panels 510 and extend beyond the edge of the respective lip 512. The plurality of screw fasteners 516 connect the flange 512 to the upper face of the panel 44. Then the flexible flap 514 of Hypalon is placed over the fasteners 516 and sealed to the Hypalon surface on the panel 44 by the Hypalon paste material represented at 517. It will be noted that the Hypalon flap 514 intersects the engaged strip fasteners of the panels. The tongue and groove portions of these engaged fasteners should be cut back beyond the edge of the flap 514 so that the Hypalon paste can be used to seal the ends of the capillaries of the fasteners as previously described.

After each of the curb flash strips 506 - 509 has been installed in this manner, a curb corner flashing member indicated generally by the reference numeral 520 in FIG. 38 is used to complete a continuous peripheral seal. The corner member 520 includes a sheet metal base member 522 over which is bonded a continuous Hypalon membrane having a flexible edge flap 524 extending around its periphery. The membrane 524 is coated around its periphery with the Hypalon paste with the bead 526 in FIG. 40 and is then placed over the corner as illustrated schematically in FIG. 38.

Finally a conventional counter flash member 530 having a peripheral skirt 532 is placed over the upper edge of the flashing strips 506 - 509 and over the upper ends of the four curb corners 520 and fasteners 532 inserted to secure the counter flash and thus the upper edges of the curb flashing strips 506 - 509 and the corner members 510 in place. This provides a continuous watertight membrane up to the level at which the fasteners 532 penetrate the membrane, which is above the design of standing water height. Of course, this is on a vertical surface and wind blown water normally will not penetrate these penetrations of the structure.

An important aspect of the present building system is that it can be installed on subframe support systems which do not have perfectly straight exterior walls or even square corners. The utilization of the edge structural member 64 provides considerable tolerance for non-straight walls since the members 64 can be placed substantially along a mean straight line. Further, the roof panels may be secured, i.e., positioned at other than exact right angles to the edge structural member at the eave of the building to accommodate non-square buildings. The edge filler member 40 and 48 and the ridge filler members 21 of FIG. 3B can be easily field trimmed to accommodate variations in the shape and size of the building substructure to which the roof system is applied. Thus, the roof system can be applied to buildings of substantially any nominal shape. Further, the system provides tolerances for non-perfect buildings to permit rapid field erection by relatively unskilled personnel in minimum time under most weather conditions.

As used in the present specification and claims, the terms Hypalon and chloro sulfonated polyethylene mean the class of synthetic materials, including fillers, marketed by DuPont Chemical Company under that trademark, the material marketed under the trademark Flex Seal by B. F. Goodrich, and other chloro sulfonated polyethylenes and mixtures thereof, and such other synthetic materials which have similar physical properties and which are therefore substantially functional equivalent within the "doctrine of equivalents" established in United States law.

What is claimed is:

1. The building system comprising:

a plurality of exterior water repellant walls each having interior and exterior surfaces and a substructure for a roof deck extending between the walls;

a plurality of panels arrayed on the supporting substructure to provide a continuous roof deck extending thereover having a top surface and an edge surface; and a continuous chloro sulfonated polyethylene membrane bonded to the roof deck including an edge flashing portion extending over the edge surface of the roof deck and connected to the water repellant walls for preventing water from reaching the interior surface of the walls, the continuous chloro sulfonated polyethylene membrane including a plurallity of chloro sulfonated polyethylene mechanical strip fasteners and sealing means interconnecting a plurality of chloro sulfonated polyethylene panels, and wherein the exterior walls include walls disposed below the edge of the roof deck which include panel means disposed along the upper edge of said walls having an upper edge inset from and disposed above the bottom edge of the edge surface of the roof deck;

the flash portion of the continuous chloro sulfonated polyethylene membrane extends downwardly around the bottom edge of the edge surfaces of the roof deck, then inwardly and upwardly over the top edge of the panel means and then down behind the panel means; and the panel means sheds water away from the interior face of the wall.

2. The building system comprising:

a plurality of exterior water repellant walls each having interior and exterior surface and a substructure for a roof deck extending between the walls;

a plurality of panels arrayed on the supporting substructure to provide a continuous roof deck extending thereover having a top surface and an edge surface; and a continuous chloro sulfonated polyethylene membrane bonded to the roof deck including an edge flashing portion extending over the edge surface of the roof deck and connected to the water repellant walls for preventing water from reaching the interior surface of the walls, the continuous chloro sulfonated polyethylene membrane including a plurality of chloro sulfonated polyethylene mechanical strip fasteners and sealing means interconnecting a plurality of chloro sulfonated polyethylene panels, and wherein the exterior walls include a parapet wall having an interior surface disposed adjacent at least one edge of the roof deck and rising above the roof deck, the parapet wall including a counter flash;

the continuous membrane extends up the parapet wall and under the counter flash whereby water on the interior surface of the parapet wall above the counter flash will be shed onto the top of the membrane;

the exterior walls include walls disposed below the edge of the roof deck which include panel means disposed along the upper edge of said walls having an upper edge inset from and disposed above the bottom edge of the edge surface of the roof deck;

the flash portion of the continuous chloro sulfonated polyethylenne membrane extends downwardly around the bottom edge of the edge surfaces of the roof deck, then inwardly and upwardly over the top edge of the panel means and then down behind the panel means; and the panel means sheds water away from the interior face of the wall.

3. The building system of claim 2 wherein:

the panel means sheds water into a gutter extending along the edge of the roof deck.

4. The building system of claim 3 wherein:

the flash portion of the chloro sulfonated polyethylene membrane is mechanically and sealingly connected to the remainder of the continuous chloro sulfonated polyethylene membrane by mechanically engageable chloro sulfonated polyethylene tongue and groove strip fastener means extending generally parallel to the edge surface of the roof deck.

5. The building system comprising:

a plurality of exterior water repellant walls each having interior and exterior surfaces and a substructure for a roof deck extending between the walls;

a plurality of panels arrayed on the supporting substructure to provide a continuous roof deck extending thereover having a top surface and an edge surface; and a continuous chloro sulfonated polyethylene membrane bonded to the roof deck including an edge flashing portion extending over the edge surface of the roof deck and connected to the water repellant walls for preventing water from reaching the interior surface of the walls, the continuous chloro sulfonated polyethylene membrane including a plurality of chloro sulfonated polyethylene mechanical strip fasteners and sealing means interconnecting a plurality of chloro sulfonated polyethylene panels, and wherein an opening in the roof deck;

a drain pipe extending to the opening in the roof deck at a level below the continuous membrane;

a pan member extending frm the end of the drain pipe and having lip means extending over the top surface of the roof deck around the opening;

fastener means penetrating the lip means of the pan member;

chloro sulfonated polyethylene membrane means bonded to the pan means and extending continuously from the end of the drain pipe over the fastener means to the chloro sulfonated polyethylene membrane on the roof deck around the opening and sealed thereto around the periphery of the lip means; and means sealing the periphery of the end of the drain pipe to the chloro sulfonated polyethylene membrane means therearound.

6. The building system comprising:

a plurality of exterior water repellant walls and a supporting substructure for a roof extending between the walls;

a plurality of panels arrayed on the supporting substructure to provide a continuous roof deck extending thereover having a top surface and an edge surface;

a plurality of chloro sulfonated polyethylene membrane panels disposed on the roof decks, each chloro sulfonated polyethylene membrane panel including a chloro sulfonated polyethylene strip fastener means extending along at least two edges thereof, the chloro sulfonated polyethylene strip fastener means on adjacent panel edges being mechanically and sealingly interconnected to form a continuous waterproof membrane between the panels, except for the openings formed where the strip fastener means terminate adjacent the contiguous corners of the chloro sulfonated polyethylene panels;

corner seal means sealing the openings through the membrane including any capillaries extending longitudinally through the ends of the strip fastener means to form a single waterproof chloro sulfonated polyethylene membrane extending over the roof deck;

the chloro sulfonated polyethylene membrane including a flashing portion extending to and overlapping the outer surface of the exterior water repellant walls.

7. The building system comprising:

a plurality of exterior water repellant walls each having interior and exterior surfaces and a substructure for a roof deck extending between the walls;

a continuous roof deck extending thereover having a top surface and an edge surface; and a continuous chloro sulfonated polyethylene membrane bonded to the roof deck including an edge flashing portion extending over the edge surface of the roof deck and connected to the water repellant walls for preventing water from reaching the interior surface of the walls, and wherein the exterior walls include walls disposed below the edge of the roof deck which include panel means disposed along the upper edge of said walls having an upper edge inset from and disposed above the bottom edge of the edge surface of the roof deck;

the flash portion of the continuous chloro sulfonated polyethylene membrane extends downwardly around the bottom edge of the edge surface of the roof deck, then inwardly and upwardly over the top edge of the panel means and then down behind the panel means; and the panel means sheds water away from the interior face of the wall.

8. The building system of claim 7 wherein:

the panel means sheds water into a gutter extending along the edge of the roof deck.

9. The building system of claim 7 wherein:

the flash portion of the chloro sulfonated polyethylene membrane is mechanically and sealingly connected to the remainder of the continuous chloro sulfonated polyethylene membrane by mechanically engageable chloro sulfonated tongue and groove strip fastener means extending generally parallel to the edge surface of the roof deck.

10. The building system comprising:

a plurality of exterior water repellant walls each having interior and exterior surfaces and a substructure for a roof deck extending between the walls;

a continuous roof deck extending thereover having a top surface and an edge surface; and a continuous chloro sulfonated polyethylene membrane bonded to the roof deck including an edge flashing portion extending over the edge surface of the roof deck and connected to the water repellant walls for preventing water from reaching the interior surface of the walls, and wherein an opening in the roof deck;

a drain pipe extending to the opening in the roof deck at a level below the continuous membrane;

a pan mamber extending from the end of the drain ipe and having lip means extending over the top surface of the roof deck around the opening;

fastener means penetrating the lip means of the pan member;

chloro sulfonated polyethylene membrane means bonded to the pan means and extending continuously from the end of the drain pipe over the fastener means to the chloro sulfonated polyethylene membrane on the roof deck around the opening and sealed thereto around the periphery of the lip means; and means sealing the periphery of the end of the drain pipe to the chloro sulfonated polyethylene membrane means therearound.

11. The building system comprising:

a plurality of exterior water repellant walls each having interior and exterior surfaces and a substructure for a roof deck extending between the walls;

a continuous roof deck extending thereover having a top surface and an edge surface; and a continuous chloro sulfonated polyethylene membrane bonded to the roof deck including an edge flashing portion extending over the edge surface of the roof deck and connected to the water repellant walls for preventing water from reaching the interior surface of the walls;

a functional passageway extending through the roof deck and chloro sulfonated polyethylene membrane;

rigid means having a flange disposed around the passageway and a tubular portion extending upwardly therefrom;

mechanical fastener means passing through the flange of rigid means and into the roof deck adjacent the passageway for attaching the rigid means to the roof deck;

continuous chloro sulfonated polyethylene membrane means bonded to and covering the tubular portion to a predetermined level above the roof deck and being bonded thereto, the chlorosulfonated polyethylene membrane means having a loose annular flap portion not bonded to the rigid means which extends over the mechanical fastener means and is sealed to the continuous chloro sulfonated polyethylene membrane on the roof deck around the periphery of the rigid means to extend the continuous chloro sulfonated polyethylene membrane upwardly to a predetermined level around the functional passageway.

12. The building system of claim 11 further characterized by counter flash means disposed around the outside of the rigid means and extending downwardly to a level below the predetermined level.

* * * * *

UNITED STATES PATENT OFFICE

CERTIFICATE OF CORRECTION

Patent No. 4,112,632 Dated September 12, 1978

Inventor(s) Harold G. Simpson

It is certified that error appears in the above-identified patent and that said Letters Patent are hereby corrected as shown below:

Column 2, line 43, "annd" should be —and—.

Column 3, line 61, "schemmatic" should be —schematic—.

Column 5, line 31, "purins" should be —purlins—.

Column 5, line 42, "guage" should be —gauge—.

Column 5, line 52, "6" should be —66—.

Column 6, line 63, "6d" should be —66d—.

Column 7, line 20, "15" should be —115—.

Column 9, line 33, after "using" insert —the splicing—.

Column 11, line 57, "50" should be —250—.

Column 11, line 58, "trip" should be —strip—.

Column 16, line 2, "surface" should be —surfaces—.

Column 17, line 7, "frm" should be —from—.

Column 18, line 38, "ipe" should be —pipe—.

Signed and Sealed this

*Nineteenth* Day of *June 1979*

[SEAL]

*Attest:*

RUTH C. MASON
*Attesting Officer*

DONALD W. BANNER
*Commissioner of Patents and Trademarks*